US006705976B1

(12) United States Patent
Piane, Jr.

(10) Patent No.: US 6,705,976 B1
(45) Date of Patent: Mar. 16, 2004

(54) EXERCISE APPARATUS

(75) Inventor: Robert A. Piane, Jr., Newark, DE (US)

(73) Assignee: BVP Holding, Inc., Newark, DE (US)

( * ) Notice: Subject to any disclaimer, the term of this patent is extended or adjusted under 35 U.S.C. 154(b) by 132 days.

(21) Appl. No.: 09/678,931

(22) Filed: Oct. 4, 2000

Related U.S. Application Data

(60) Provisional application No. 60/223,554, filed on Aug. 6, 2000.

(51) Int. Cl.[7] ..... A63B 21/062

(52) U.S. Cl. ..... 482/103; 482/102; 482/138

(58) Field of Search ..... 482/99–103, 123, 482/129, 130, 139, 138, 135, 909; 73/158; 242/912; 254/400

(56) References Cited

U.S. PATENT DOCUMENTS

| | | | | | |
|---|---|---|---|---|---|
| 3,306,611 | A | | 2/1967 | Gaul | |
| 4,195,834 | A | | 4/1980 | Lambert, Jr. | |
| 4,549,733 | A | | 10/1985 | Salyer | |
| 4,603,855 | A | | 8/1986 | Sebelle | |
| 4,621,807 | A | * | 11/1986 | Stramer | 482/100 |
| 4,697,809 | A | * | 10/1987 | Rockwell | 482/102 |
| 4,721,303 | A | | 1/1988 | Fitzpatrick | |
| 4,744,559 | A | | 5/1988 | Mahnke et al. | |
| 4,784,384 | A | * | 11/1988 | Deola | 482/99 |
| 4,856,773 | A | * | 8/1989 | Deola | 482/102 |
| 4,898,381 | A | | 2/1990 | Gordon | |
| 5,018,725 | A | | 5/1991 | Cook | |
| 5,044,629 | A | | 9/1991 | Ryan et al. | |
| 5,102,122 | A | | 4/1992 | Piane, Jr. et al. | |
| 5,195,937 | A | | 3/1993 | Engel et al. | |
| 5,250,013 | A | * | 10/1993 | Brangi | 482/98 |
| 5,267,930 | A | * | 12/1993 | Henes | 482/139 |
| 5,417,633 | A | * | 5/1995 | Habing | 482/97 |
| 5,518,477 | A | * | 5/1996 | Simonson | 482/102 |
| 5,725,459 | A | | 3/1998 | Rexach | |
| 5,842,961 | A | * | 12/1998 | Davis | 482/102 |
| 6,165,110 | A | | 12/2000 | Gajda | |
| 6,217,493 | B1 | * | 4/2001 | Spletzer | 482/103 |
| 2003/0027694 | A1 | * | 2/2003 | Harrison | 482/94 |

* cited by examiner

*Primary Examiner*—Nicholas D. Lucchesi
*Assistant Examiner*—Victor Hwang
(74) *Attorney, Agent, or Firm*—Milde & Hoffberg, LLP

(57) ABSTRACT

Exercise equipment including a housing having a structural surface defining an arcuate path, multiple pairs of pulleys positioned along the arcuate path, each pair of pulleys having passed between them a cable the proximal end of which is located outside the curved path, the distal end of the cable being coupled to a source of resistance within the housing such that when the proximal end of the cable is pulled by a user, the resistance exerts a counterforce to the cable. Alternatively, a single cable may be provided which exits through a movable trolley which is fixable at different positions along the arcuate path.

71 Claims, 31 Drawing Sheets

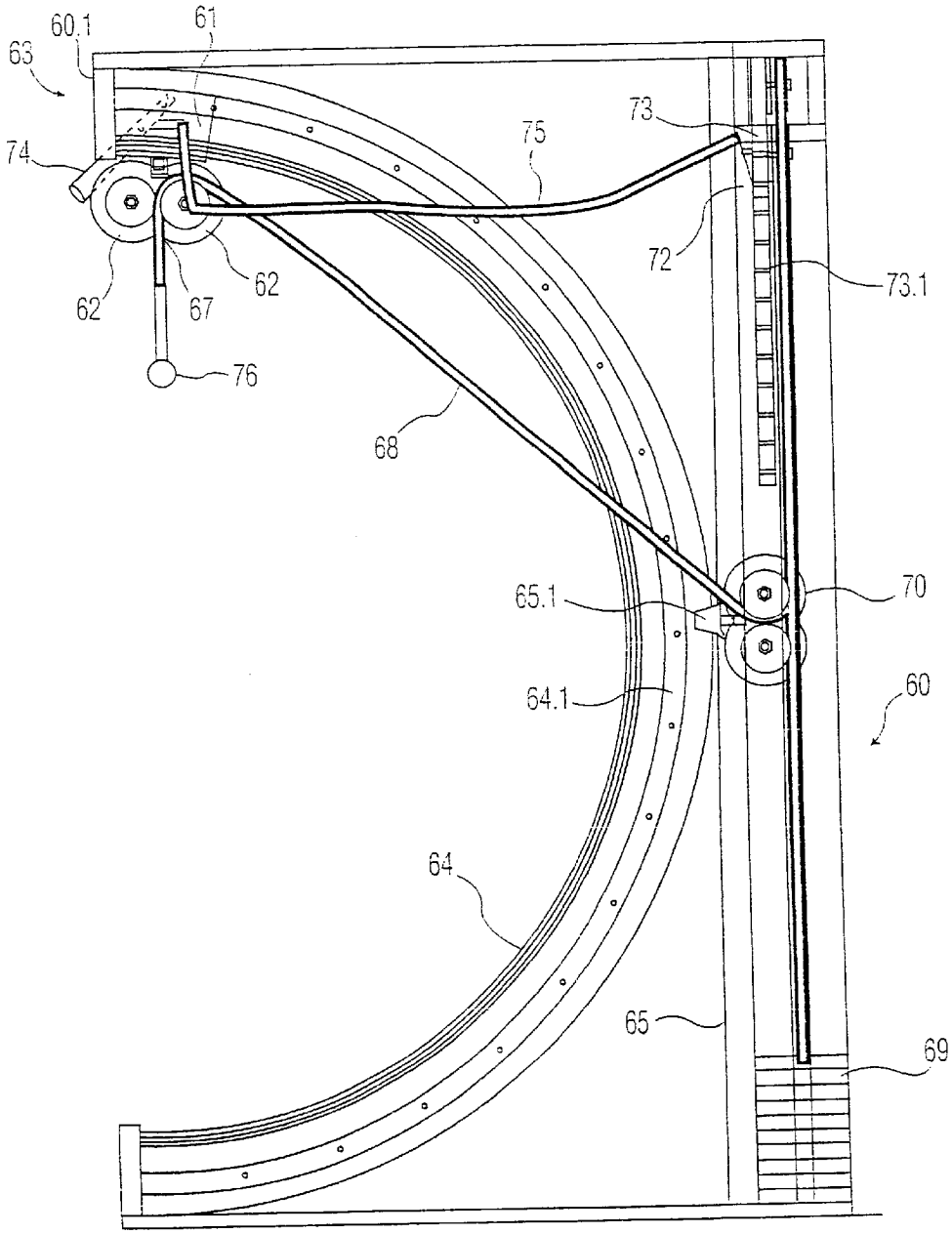
FIG. 30
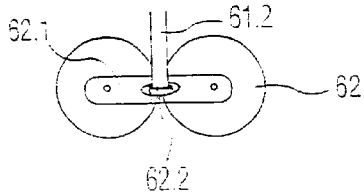
FIG. 30.1

EXERCISE APPARATUS

CROSS-REFERENCE TO RELATED APPLICATION

This application is related to, and claims priority from, U.S. Provisional Application No. 60/223,554, filed Aug. 6, 2000.

BACKGROUND OF THE INVENTION

The present invention relates to body exercise equipment.

Many units of exercise equipment have been disclosed or put into actual use in which a cable is drawn against a resistance source by an individual exercising with the equipment. Typically, these units of equipment include a handle attached to one end of a cable with a resistance source, such as weights, opposing the pulling of the cable. Different exercises can be performed by adjusting the vertical position at which the cable leaves the equipment. That adjustability, however, provides only a limited variety of exercises.

U.S. Pat. No. 4,603,855 discloses exercise equipment in which the handle, grasped by the individual using the equipment, can undergo three degrees of movement as it is positioned for a selected exercise. Although such equipment provides added adjustability, whereby many more exercises are possible, the particular arrangement disclosed in this patent, which includes mounting the handle on a telescoping arm, lacks sufficient strength and stability when constructed from conventional components or becomes very expensive to manufacture when special components are used to provide greater strength and stability.

In other exercise equipment sold by Eigin Exercise Equipment Corporation of Des Plaines, Ill., the handle grasped by the user is movable to the desired position by a trolley, which moves along a curved rod track. This equipment also provides added facility for a variety of different exercises. However, the framework support structure of this exercise equipment, particularly the single arced bar used to relocate the egress point, also provides only limited strength and stability when constructed from conventional components or becomes very expensive to manufacture when special components are used to provide greater strength and stability.

Only very light resistances can be used in this design or the framing and supports will bend and damage easily. It also requires the user to perform multiple steps to adjust the equipment for a desired exercise, particularly with regard to taking up the slack created in the cable when moving the egress point from place to place along the curved rod.

Other prior art that may be mentioned are the following U.S. Pat. Nos.:

| | | | |
|---|---|---|---|
| 3,306,611 | 4,549,733 | 4,898,381 | |
| 5,018,725 | 5,102,122 | 5,195,937 | 5,725,459 |

None of these is all that relevant to the present invention, except one, which is of some interest, i.e., U.S. Pat. No. 5,102,122. This patent uses a movable trolley that must be repositioned for each egress point for the handle from the exercise equipment required for a desired exercise position and two additional steps to release the locking mechanism for the cable take-up means before repositioning the trolley and to lock it again after it is in a new position.

Cable-cross units of equipment now currently available, provide a single step movable trolley that repositions an egress point along a straight bar, typically vertical in position, and typically have two such trolleys oriented side by side and spaced so a user can train in between them. Such designs do not optimize the interaction with basic human movement, do not provide a full 360-degree training environment in which to train, particularly limited in delivering resistance from training vectors overhead as well as from below. Also, when switching from a linear track design to a curved track, cable slack and changes in length relative to the egress point and the cable end that connects to the attachment create a serious problem. To correct this problem a counterweight system as shown in patent U.S. Pat. No. 5,102,122 can be used (but which calls for added steps to reposition the trolley due to the need to manually release the cable take-up means, unlock the trolley, move the trolley, relock the trolley and then relock the cable take-up means.)

SUMMARY OF THE INVENTION

The human body moves primarily in circular or rotating paths of motion as evidenced by Davinci's Study of Human Proportions. From a biomechanical standpoint, resistance exercise units of equipment designed with resistance delivery systems oriented along an arced pathway are inherently more biomechanically optimized than those that are not, thus offering tremendous advantages to the user. Also, the invention provides units of equipment that allow for the minimum number of adjustments, ease of use and orientation of the user to change the desired exercise parameters and shorten the work out time, the ability to preset or easily reset the attachments. The sequence of various exercises, are intuitively understood, safer to use, provide a greater range of resistance, service a wider range of users and a wider range of needs with the capability of providing an infinite number of resistance training possibilities and protocols, is handicapped and wheelchair accessible, provides a simple method to record their work and progress in three-dimensional space, is aesthetically pleasing and unique in appearance and provides a 360 degree workout environment.

It is an object of this invention to provide a line of advanced pulley system exercise units of equipment which provide the user all the benefits of free weight lifting yet are safer, more versatile and easier to use, are distinct in their product styling and design, can easily be customized to meet the demands of a wide variety of users with a wide variety of needs and provide a means whereby a user can perform more specific exercises on fewer units of equipment.

It is an object of this invention as well to provide more specifically tailored units of equipment using fewer parts.

It is another object of this invention to provide units of equipment that can also work in conjunction with a wide variety of attachments, with uniquely designed multipurpose benches and versatile, multipurpose chairs to greatly expand the variety of options they provide for the user and to appeal to the widest possible range of users.

It is also an object of this invention to allow for only one adjustment to be made, the selection of the desired resistance, in order to exercise any part of the body (excluding, of course, the changing of an attachment).

It is yet another object of this invention to provide means to position two or more fixed egress pulley means positioned along a variety of single or dual walls or framed structure, or single or dual tracks, rails, tubes or cylinders or other support means of a variety of shapes other than just a straight line (yet could include a variety of straight line and curved combinations) relative to a user pulling on a handle connected to a connecting means attached to a resistance means and having one or more cable take-up means which enable the user to perform an infinite variety of exercises for muscular development or rehabilitation on more ergonomically efficient, optimally comfortable, easier to use and understand, resistance exercise devices.

It is an object of this invention to provide safer and more stable and user-friendly resistance units of equipment, which are more economically feasible to manufacture by maximizing economies of scale due to more standardization of parts that can be used to create a wider variety of units of equipment and which exercise both the prime movers as well as the stabilizer muscles in the human body in an infinitely positionable and unrestrained way.

It is a further object of this invention to provide designs that also allow for the development of Total Body units which use a standard set of parts which can be used to create a whole line of exercise units of equipment utilizing various combinations and mixes of egress points along one or two of the various shaped paths as they are positioned relative to the user in unilateral and bilateral formations which themselves can be fixed or move relative to themselves to create varying points of egress for the user to grab onto attachments connected to the connector means allowing for the creation of a line of units of equipment which enables the user to train specific body parts in a wider variety of ways.

It is a still further object of this invention to allow the user a means to record which training vector in three-dimensional space they are exercising in so they can record and repeat their movement patterns each time they use the units of equipment.

These objects and others that will become apparent from the following specification are achieved by exercise equipment including a housing having a curved path, multiple pairs of pulleys positioned along the curved path, each pair of pulleys having passed between them a cable, far from the proximal end of which is the distal end of the cable being attached to a source of resistance and the proximal ends being located outside the curved path and attached to a means that enables the user to exert force against the resistance. The resistance may be variable. The resistance may be a set of weights, for example. A set of counterweights may be used to act as a cable-take-up means when different egress points along the curved track are utilized.

An economy model of the exercise equipment includes a framed housing having a curved track defining a prescribed curved path, a pair of pulleys on a movable trolley repositionable along the curved path, and having passed between them a cable, the proximal end of which is located outside the curved track and attached to a means that enables the user to exert force against the resistance, to which the distal end of the cable is attached. The resistance may be variable. The resistance may be a set of weights. A set of counterweights may be used to act as a cable-take-up means when different egress points along the curved track are utilized.

Means for allowing the user to exercise force against a resistance may be a handle, strap, belt, rope, bar or any other means that are useful in exercising.

The exercise equipment is arranged for engagement by one arm or one leg or one body part at a time. If both arms or both legs or one of each or more than one body part are to engage the equipment simultaneously, two points of force application (i.e., universal connectors), suitably located, are provided and the overall exercise equipment has two parts. The two parts can be separate units, placed side-by-side, parallel or at selected relative angles, or they can be integrated into a unitary construction. Although in the following description of the present invention reference is made to engagement by and exercise of the arms and legs, by the use of suitable attachments to the universal connectors, other body parts such as the torso, neck, hips, shoulders, chest and back also can be engaged and exercised.

In contrast to the prior art, multiple fixed egress points of the present invention provide a multitude of egress points for handles. It is merely necessary to grasp a handle at the desired egress point—no repositioning is necessary.

The movable trolley equipment of the present invention allows for one step to reposition a movable trolley along an arced track and provides a sturdy, less expensive frame and a single track for the trolley to move along to relocate the egress point from which to train with both light and heavy resistances. The invention can comprise a mechanically or electronically actuated brake using levers, cables, pins, pads, or other braking means that is activated when the release mechanism for repositioning the trolley is used. When the mechanism to reposition the trolley is activated, the brake is released on the cable take-up means. When the trolley is repositioned and locked in place the brake is simultaneously locked. The brake cable and cable take-up mechanism are oriented in such a way that when the trolley is moved along the arced path, the cable length remains constant with regards to the egress point and the cable end that connects to the attachment. This brake and cable take-up system can be applied in both a fixed end and closed loop cable system. It can also be used when the take-up means is between the point of egress and the resistance means, or past the end of the resistance means as shown in patent U.S. Pat. No. 5,102,122.

There may be additional exercise equipment positioned near the exercise equipment of the invention for either style, i.e., the fixed point system or the movable trolley system. Two units of equipment are capable of being used simultaneously by a single user exercising two limbs or other parts of his or her body simultaneously or by two users simultaneously. The two units of equipment may be placed side-by-side parallel or at selected relative angles. They may be integrated into a unitary construction and may utilize a multifunctional chair or bench, which can be positioned to cooperatively function with the exercise equipment. The curved tracts may also be affixed to frames, which allow each to rotate vertically around to create a 360-degree totally repositionable workout environment about the user while he/she is positioned between the curved tracts as shown in U.S. Pat. No. 5,102,122.

BRIEF DESCRIPTION OF THE DRAWINGS

FIG. 30 is a right side view of the model of FIG. 26

FIG. 30.1 is an enlarged view of the model of FIG. 30

DETAILED DESCRIPTION OF THE INVENTION

FIGS. 1–19 illustrate a first preferred deluxe embodiment of the invention.

FIGS. 20–25 illustrate an optional chair or bench that may be used with the units of equipment of the invention.

FIGS. 26–31 illustrate a simpler, economy embodiment of the invention.

In FIGS. 1 to 31, the same or similar parts are identified by the same reference number.

Figure 1:
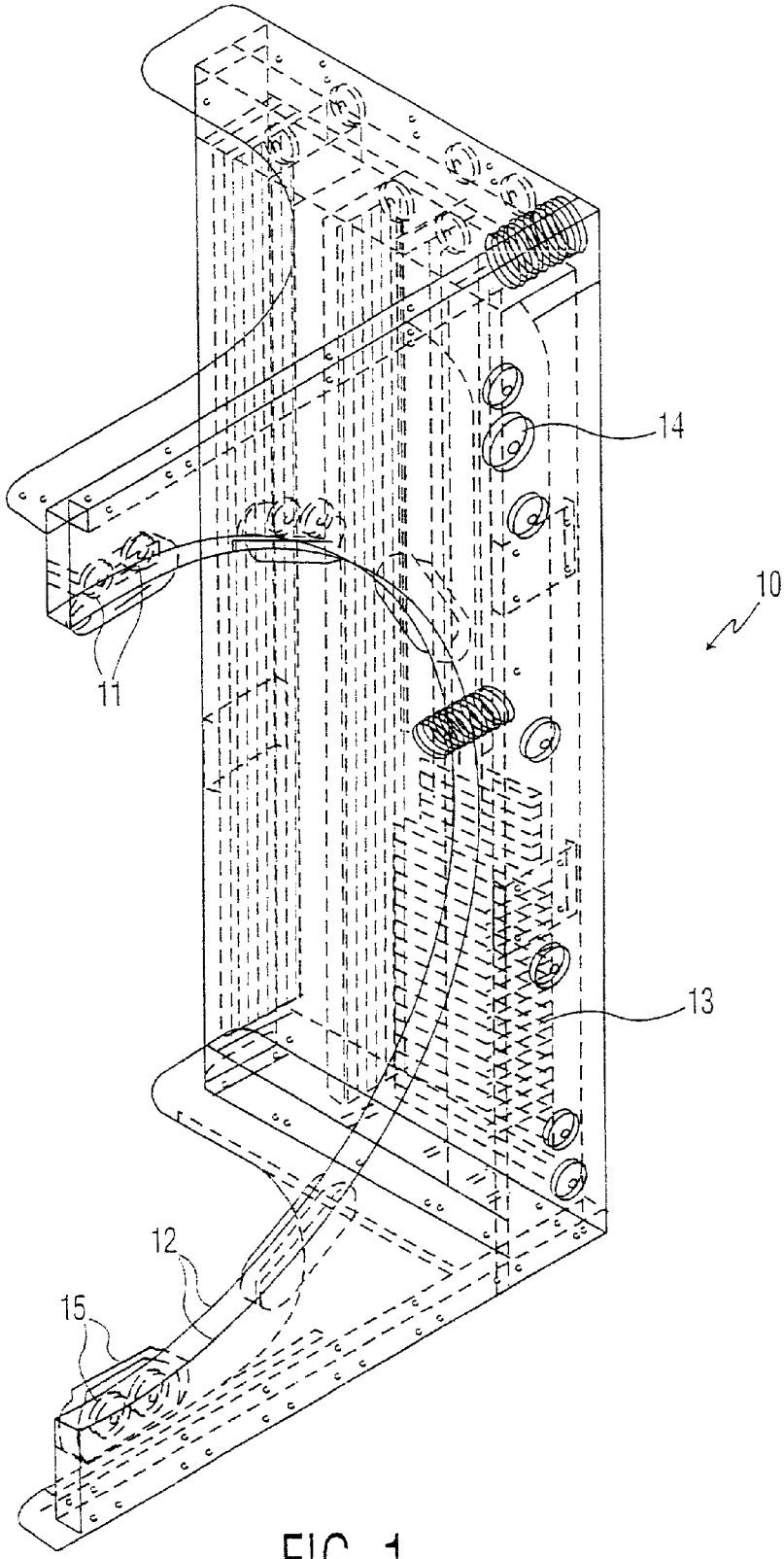
FIG. 1 is an x-ray side top isometric view of one embodiment of exercise equipment constructed in accordance with the present invention.

FIG. 1 is an x-ray side top isometric view of one embodiment of exercise equipment 10 constructed in accordance with the present invention. There are seven pairs of pulleys, one pair of which is identified as 11, placed in the arcuate slot formed by the two side frames 12 and each pair is spaced 30° away from its neighbor(s), as may be better seen in FIG. 2. A greater or smaller number of pairs of pulleys could be used. The resistance, a weight stack 13 is comprised of a number of small weights that can be used in combination. In order to further simplify and thereby clarify the description in FIGS. 1–2, 5–15 and FIG. 19, cables 9 have generally been omitted as well as their paths through the series of rollers 15, pairs of pulleys 11 and multiple pulleys 14.1 and 14.2. The proximal end of each of the cables 9, outside rollers 15, is attached to a means that enables a user to exert force against the resistance. The distal ends of the cables 9 are threaded between rollers 15 and pulleys 11 and then through a series of pulleys identified as 14.1 and 14.2.

Figure 2:
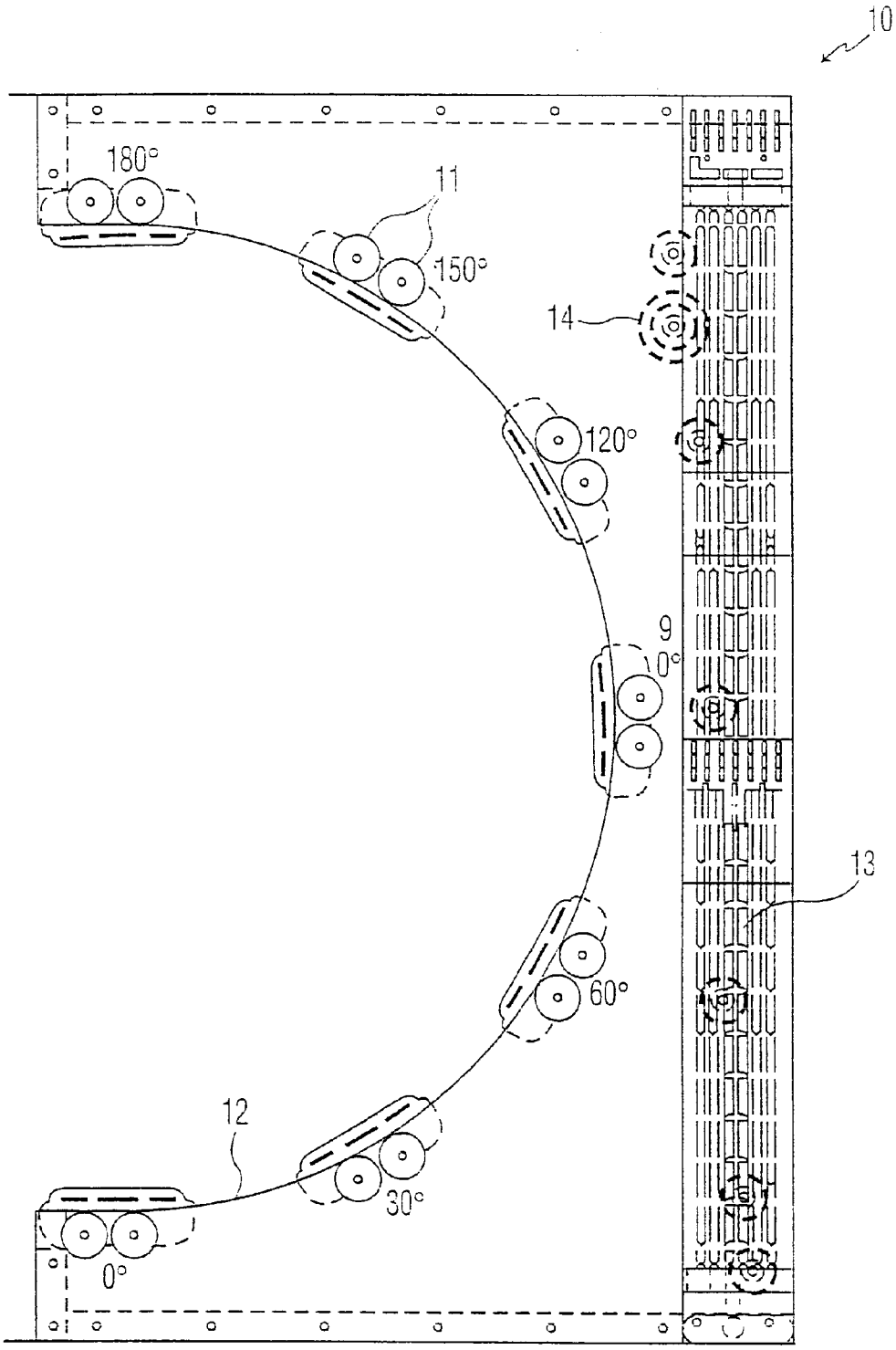
FIG. 2 is a simplified x-ray side view of the exercise equipment in FIG. 1.

FIG. 2 is a simplified x-ray side view of the exercise equipment 10 in FIG. 1. The parts illustrated have been identified in the description of FIG. 1. FIG. 2 shows markings on the side frame 12 of the equipment that indicate the position of the pulleys on the arc of the equipment.

Figure 3:
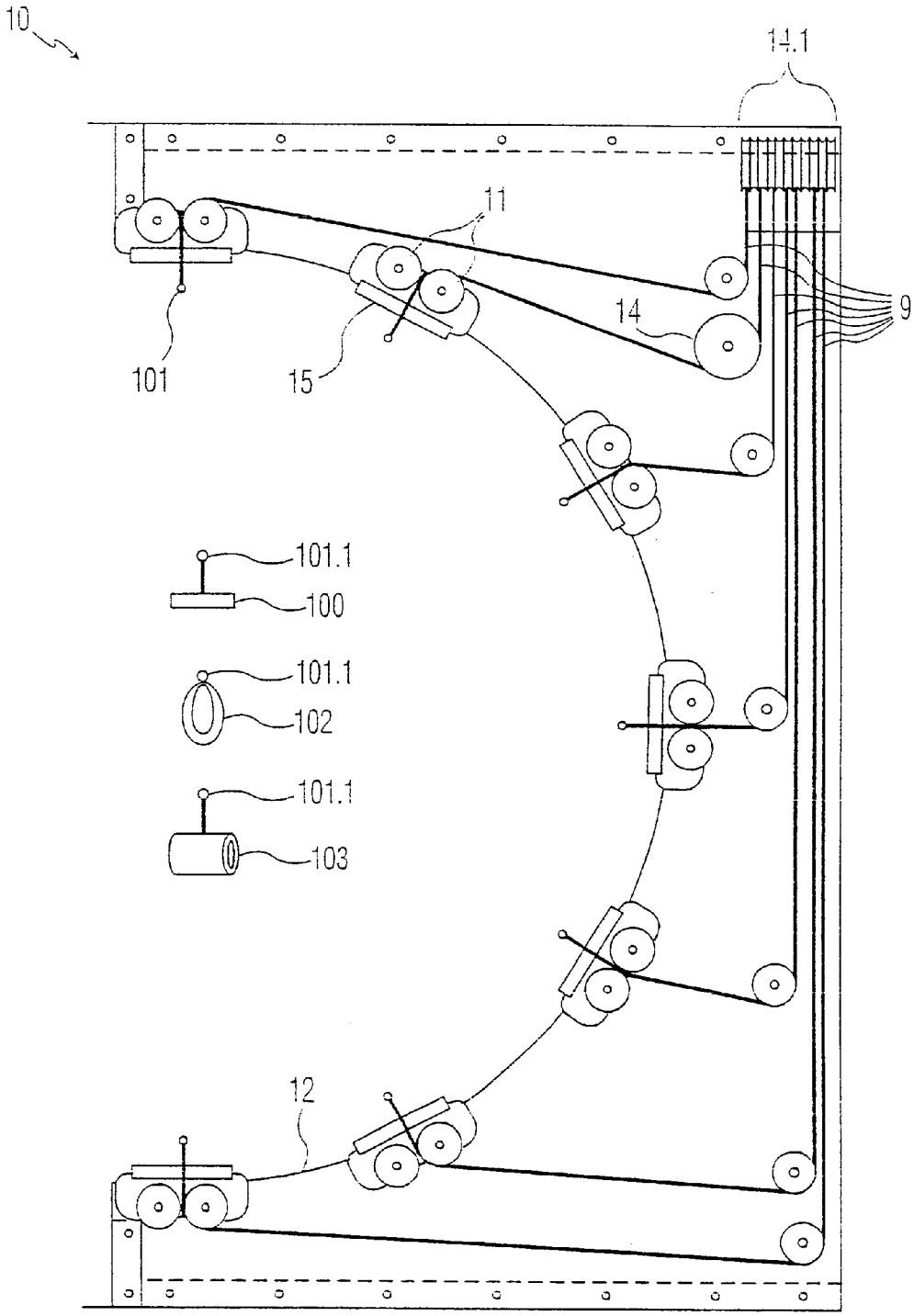
FIG. 3 is more detailed x-ray side view of the exercise equipment in FIG. 1.

FIG. 3 is a more detailed x-ray side view of the exercise equipment 10 in FIG. 2. The proximal end of each of the cables 9, outside rollers 15, is attached to a means that enables a user to exert force against the resistance. Examples of those means are a bar 100, a loop handle 102 and a cuff 103, all of which have a fastener 101.1 that enables them to be attached to fastening point 101 at the proximal ends of cables 9. For example, the bar 100, loop handle 102 and cuff 103 may be mixed or matched at the proximal ends of cables 9. Seven cables 9 are strung from the proximal end external to the equipment 10 through pairs of pulleys 11 from which they exit in generally horizontal position to the right where they pass over redirection pulleys 14 to change direction to vertically upward. The pulleys 14 serve to redirect the cables 9 from a generally horizontal incoming direction to vertical upward direction. The remainder of the parts depicted in FIG. 3, with the exception of Pulleys 14.1, are described in the description of FIGS. 1, 4, 8, 10 and 11. Pulleys 14.1, of which there are seven aligned vertically all of which are identified, serve to redirect the distal ends of the cables 9 from a generally vertical upward direction to a substantially horizontal direction to seven aligned pulleys 14.2 (only two of which are shown) and serve to redirect cables 9 to a substantially vertical downward direction. The distal ends of the cables 9 after pulleys 14 are shown in FIG. 4.

Figure 4:
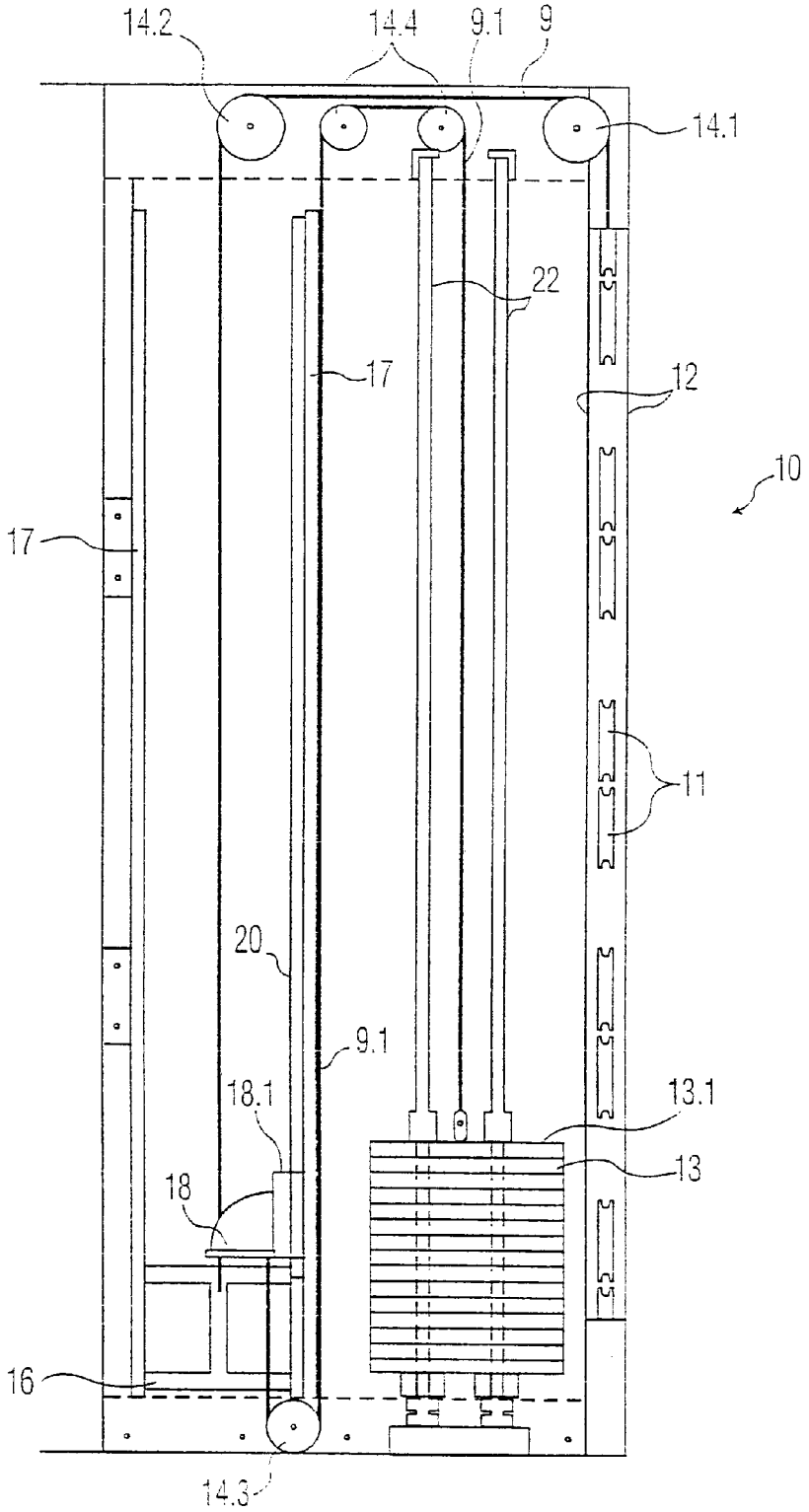
FIG. 4 is an x-ray front view of a portion of the exercise equipment in FIG. 1.

FIG. 4 is an x-ray front view of a portion of the exercise equipment in FIG. 1. FIG. 4 illustrates in more detail how one cable 9.1 is strung through the equipment 10. The cables 9 are horizontally redirected when they pass over pulleys 14.1 and then vertically downward as they pass over pulleys 14.2 where the distal ends of cables 9 are attached to counterweights 16. When the proximal end of a cable 9 is pulled, it raises the counterweights 16. A horizontal plate 18 with holes, slots or other openings cut so the cables 9 pass through the plate 18 is positioned above the counterweights 16 and extended over and attached or welded to a vertically positioned guiding means, e,g., a linear bearing 18.1 (or other guiding mechanism such as a roller system, or a bushing housed in a tube traveling on a rod, bar or other vertical support) traveling along a vertical shaft 20 positioned between the weight stack 13 and the counterweights 16. Single cable 9.1, which is attached to the underside of horizontal plate 18 and to a pulley 14.3 below, then routed upward to two pulleys 14.4 above the weight stack and down to a plate 13.1 to guide the weights 13 vertically along two upright guide rods 22 extending downward through the weight stack 13 and a rod 23 extending downward through the center of the weight stack with holes 24 cut in it to allow a selector pin 25 to slide into the weight stack 13 so the user can select the desired weight to lift. When the user pulls on the cable 9 end at the point of egress, the counterweight 16 is lifted, thereby lifting the horizontal plate assembly 18 and the selected weight 13. Other cables 9 in the system that are not engaged by the user at that time are held in the ready position by their respective counterweights 16.

Figure 5:
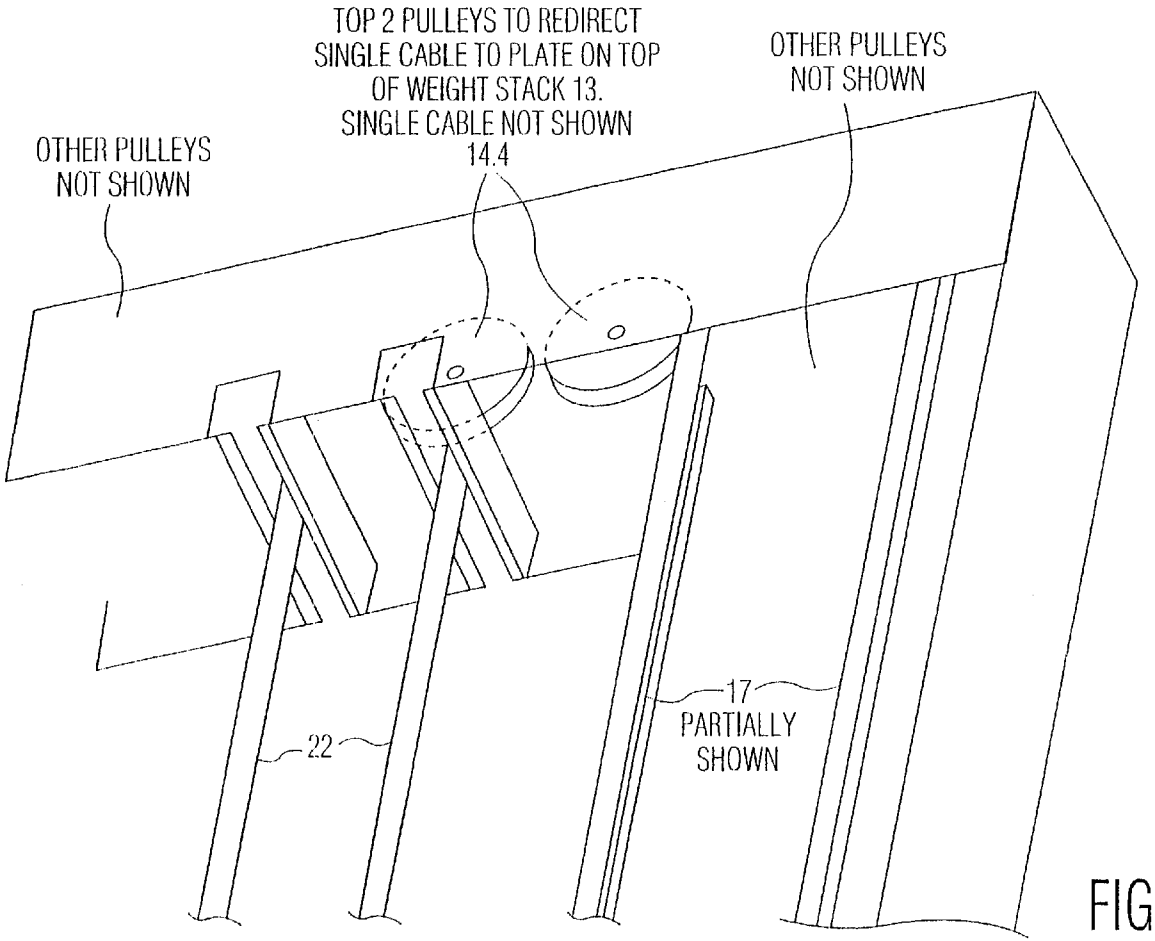
FIG. 5 is a partial isometric view of the top of the equipment.
Figure 6:
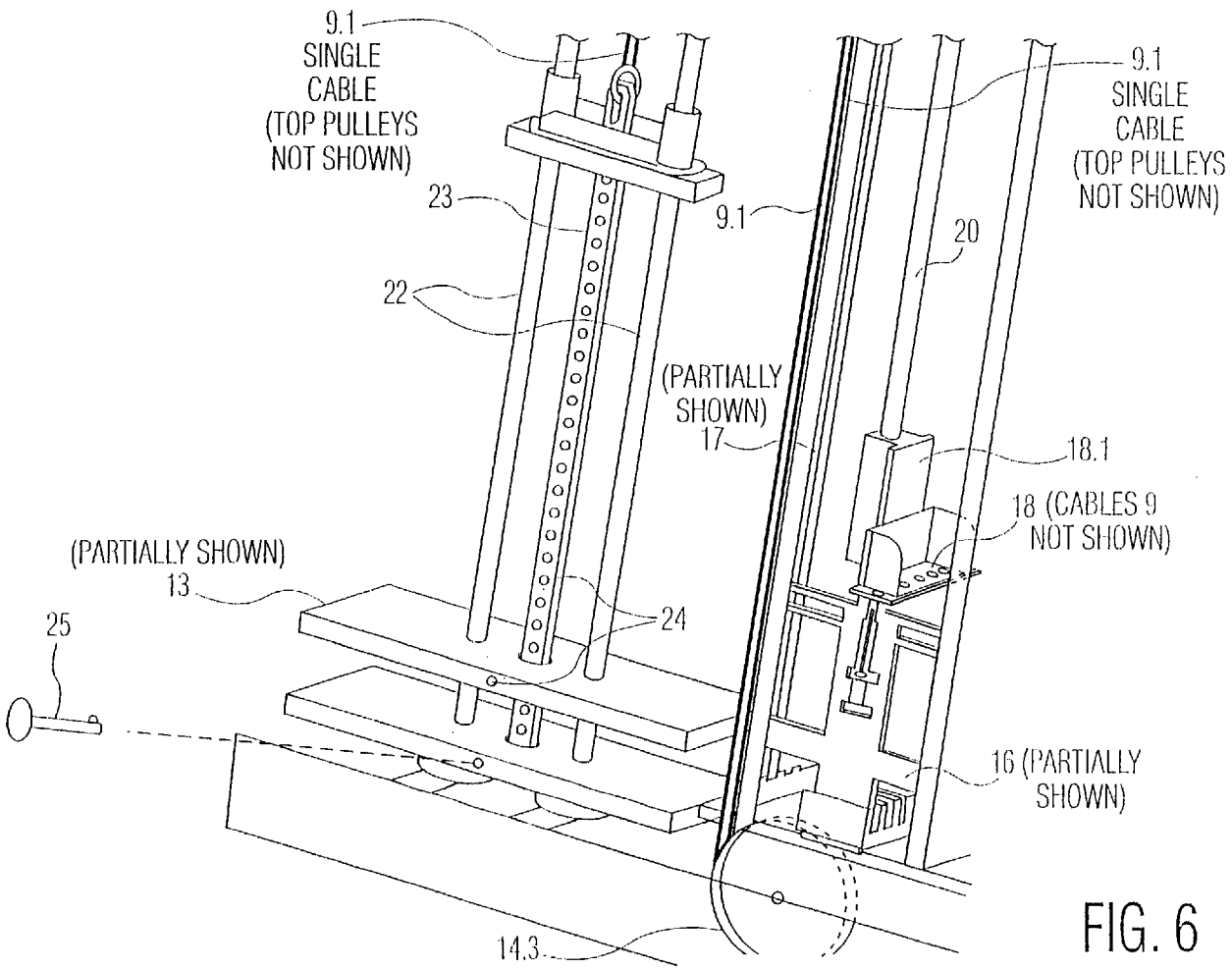
FIG. 6 is a partial isometric view of the bottom of the equipment.
Figure 10:
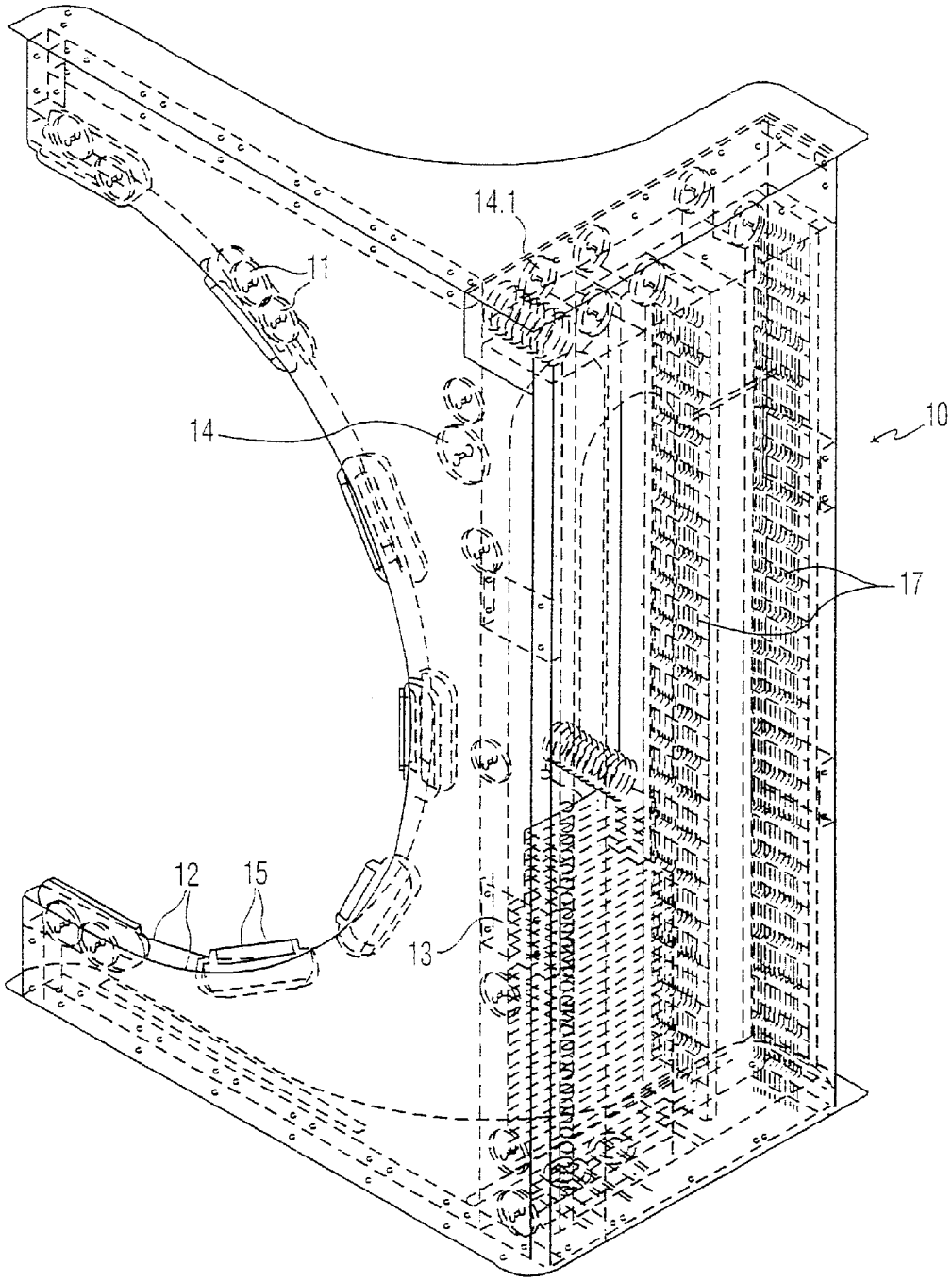
FIG. 10 is an x-ray top isometric view of the exercise equipment constructed in accordance with the present invention.

As may be seen in other FIGS., ultimately, the distal ends of the cables 9 are attached to a counterweight 16, which travels vertically through a slot mounted in a housing with each slot and counterweight 16 positioned side by side at the end of each respective cable 9, (one counterweight 16 for each cable 9 threaded through the system) positioned next to the resistance, which in this case is a set of weights 13, and housed within a vertical set of guide tracks 17 (see FIGS. 5, 6 and 10). They are positioned within the housing on the far side of the weights, but could be positioned in other arrangements relative to the resistance. Optimal positioning is next to or adjacent to the resistance. The counterweights 16 are optimally also positioned at or slightly beneath the top plane of the weight stack 13, but could be positioned above the top plate.

FIG. 5 is a partial isometric view of the top of the equipment 10.

FIG. 6 is a partial isometric backside view of the bottom of the equipment 10.

Figure 7:
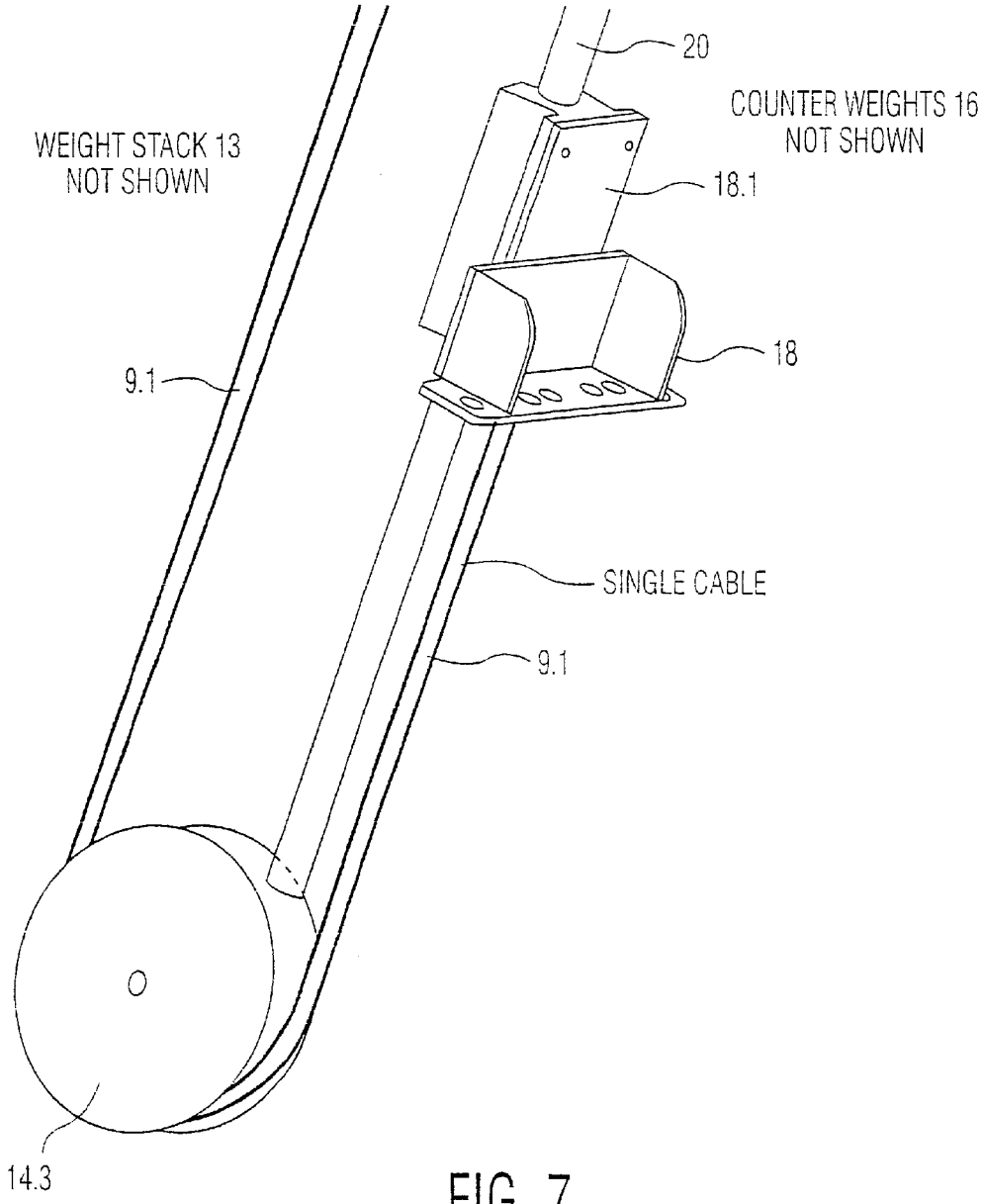
FIG. 7 is an enlarged view of part of FIG. 6.

FIG. 7 is an enlarged view of part of FIG. 6.

Figure 8:
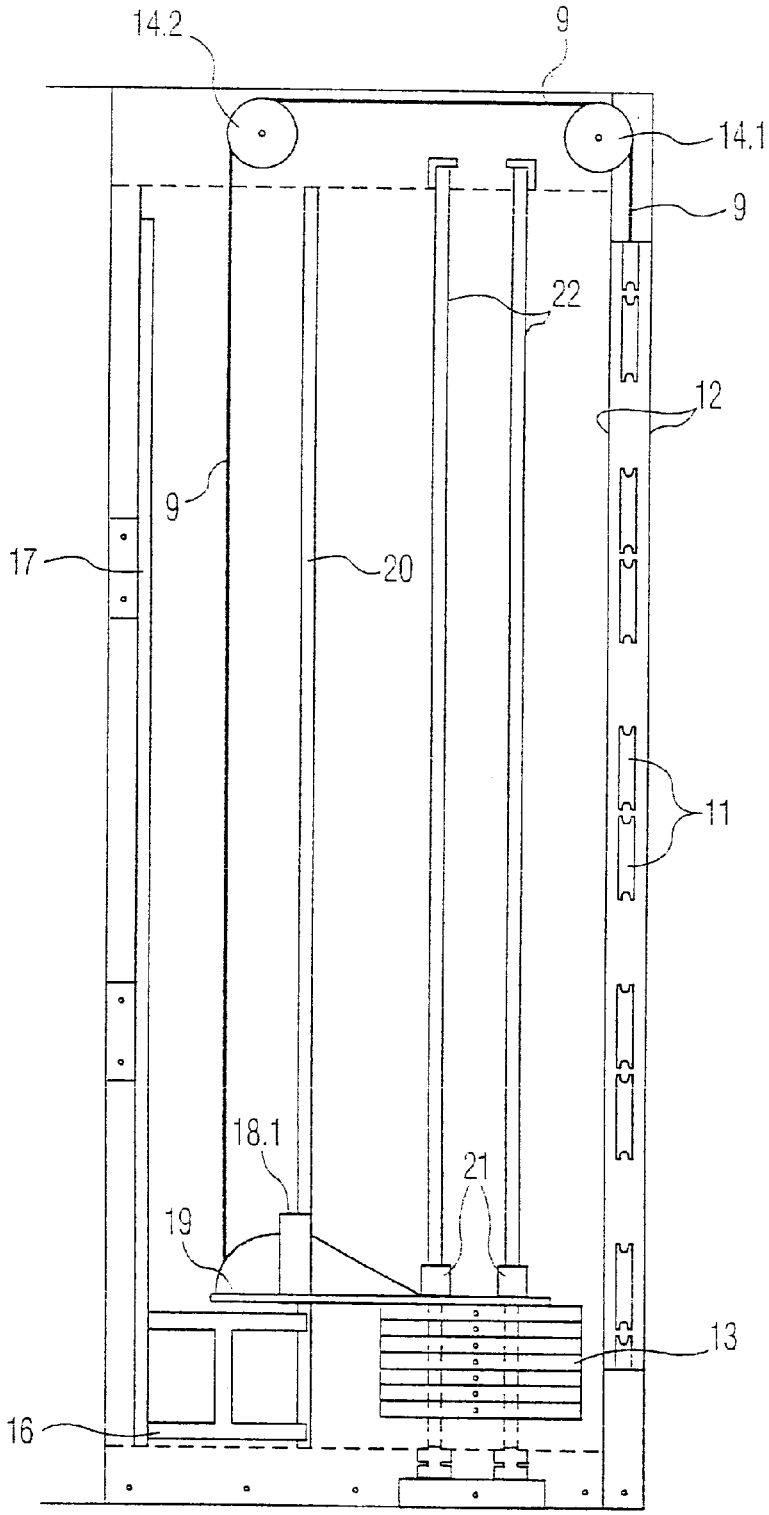
FIG. 8 shows a variation of FIG. 4.

FIG. 8 shows a variation of FIG. 4. Another method of lifting the weight stack is to have the horizontal plate 19 (see FIG. 9) attached to the linear bearing 18.1 extended to reach out over the weight stack 13 and fastened or welded to a set of guide tubes 21 to guide the weights 13 vertically along two upright guide rods 22 extending downward through the weight stack 13 and a rod 23 extending downward through the center of the weight stack with holes 24 cut in it to allow a selector pin 25 to slide into the weight stack 13 so the user can select the desired weight to lift. When the user pulls on the proximal end of cable 9 at the point of egress, the counterweight 16 is lifted, thereby lifting the horizontal plate assembly 19 and the selected weight 13. Other cables 9 in the system that are not engaged by the user at that time are held in the ready position by their respective counterweights 16.

Figure 9:
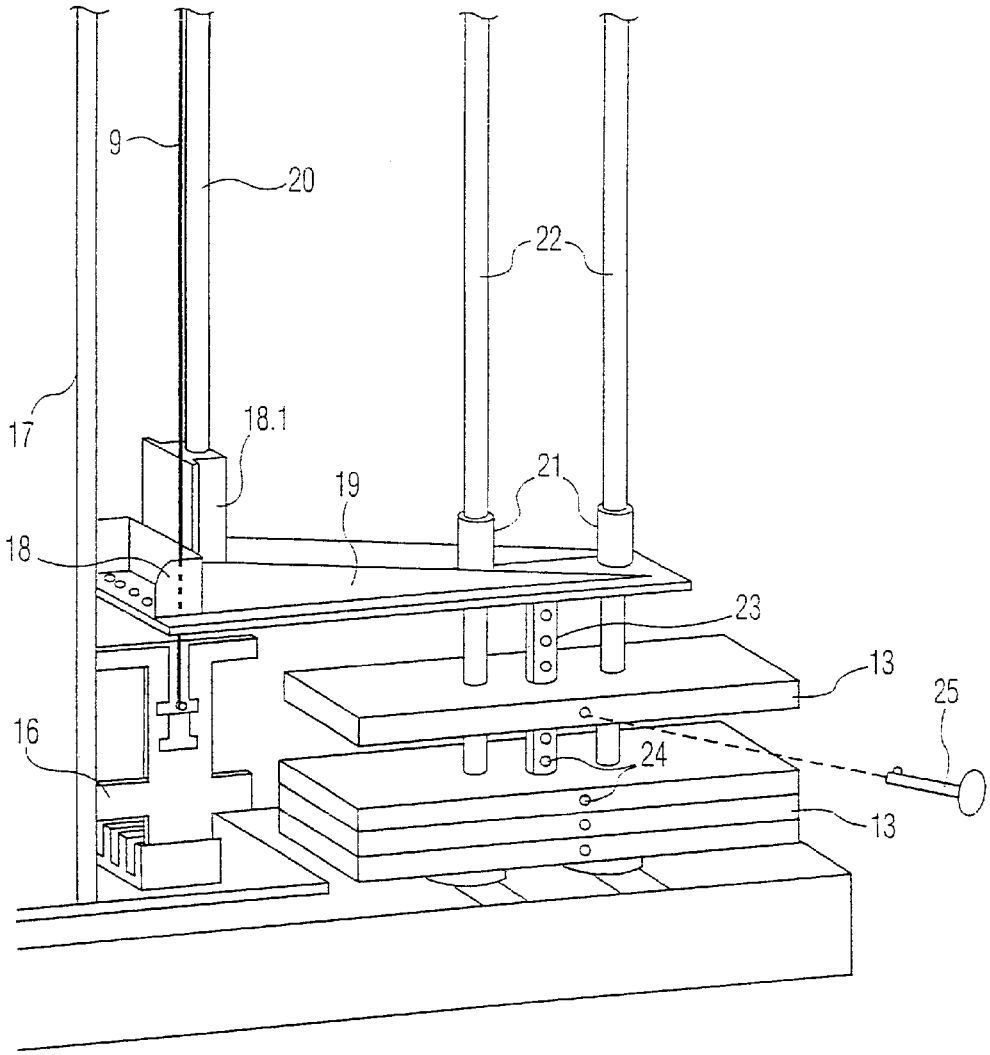
FIG. 9 illustrates a variation of the bottom of the equipment 10 shown in FIG. 6.

FIG. 9 illustrates a variation of the bottom of the equipment 10 shown in FIG. 6.

FIG. 10 is an x-ray top isometric view of the exercise equipment 10 constructed in accordance with the present invention. The parts illustrated in this FIG. have been described in connection with the previous FIGS.

Figure 11:
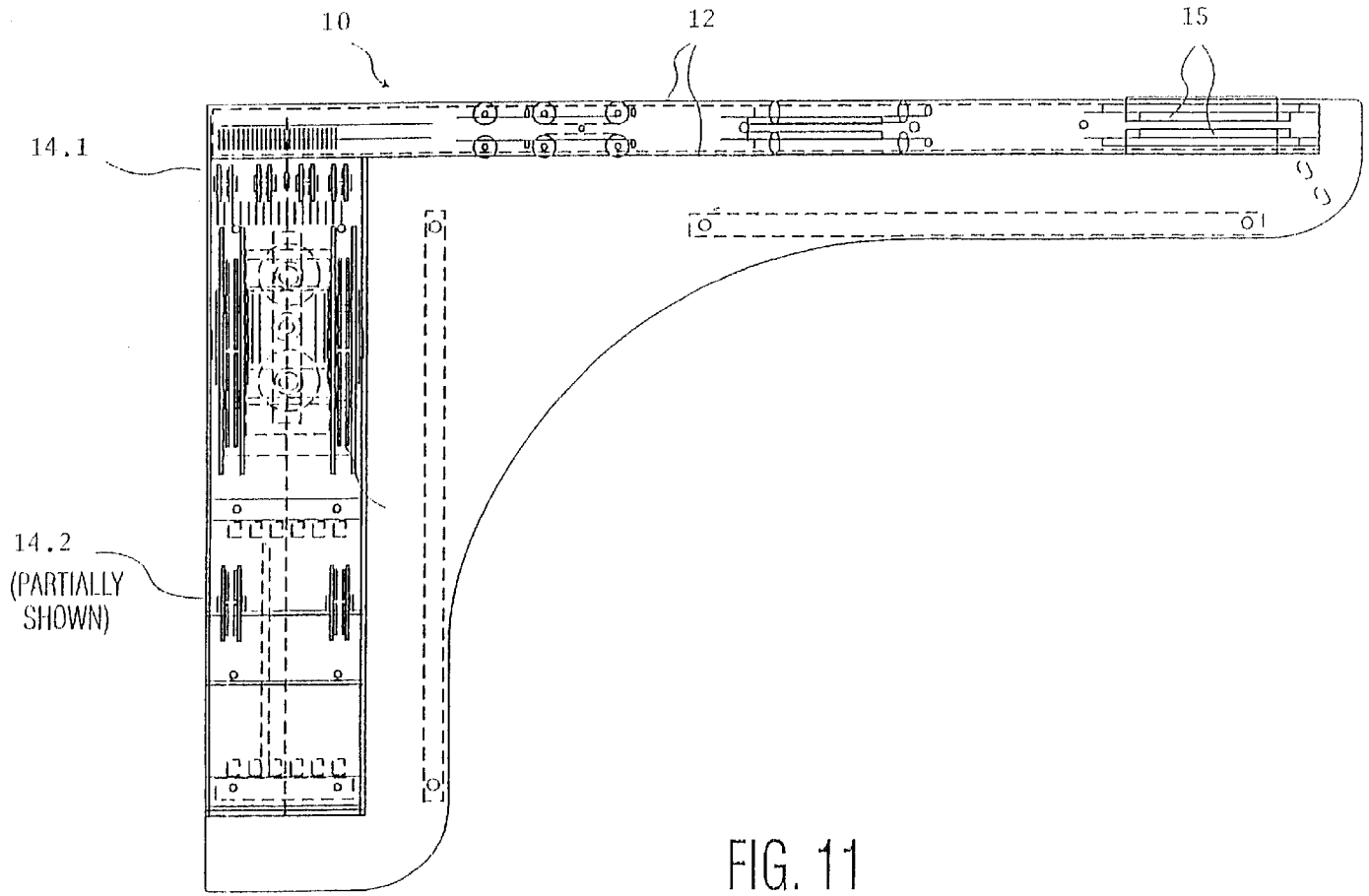
FIG. 11 is an x-ray top view of the exercise equipment.

FIG. 11 is an x-ray top view of the exercise equipment 10. The parts depicted have been described in connection with the previous FIGS.

Figure 12:
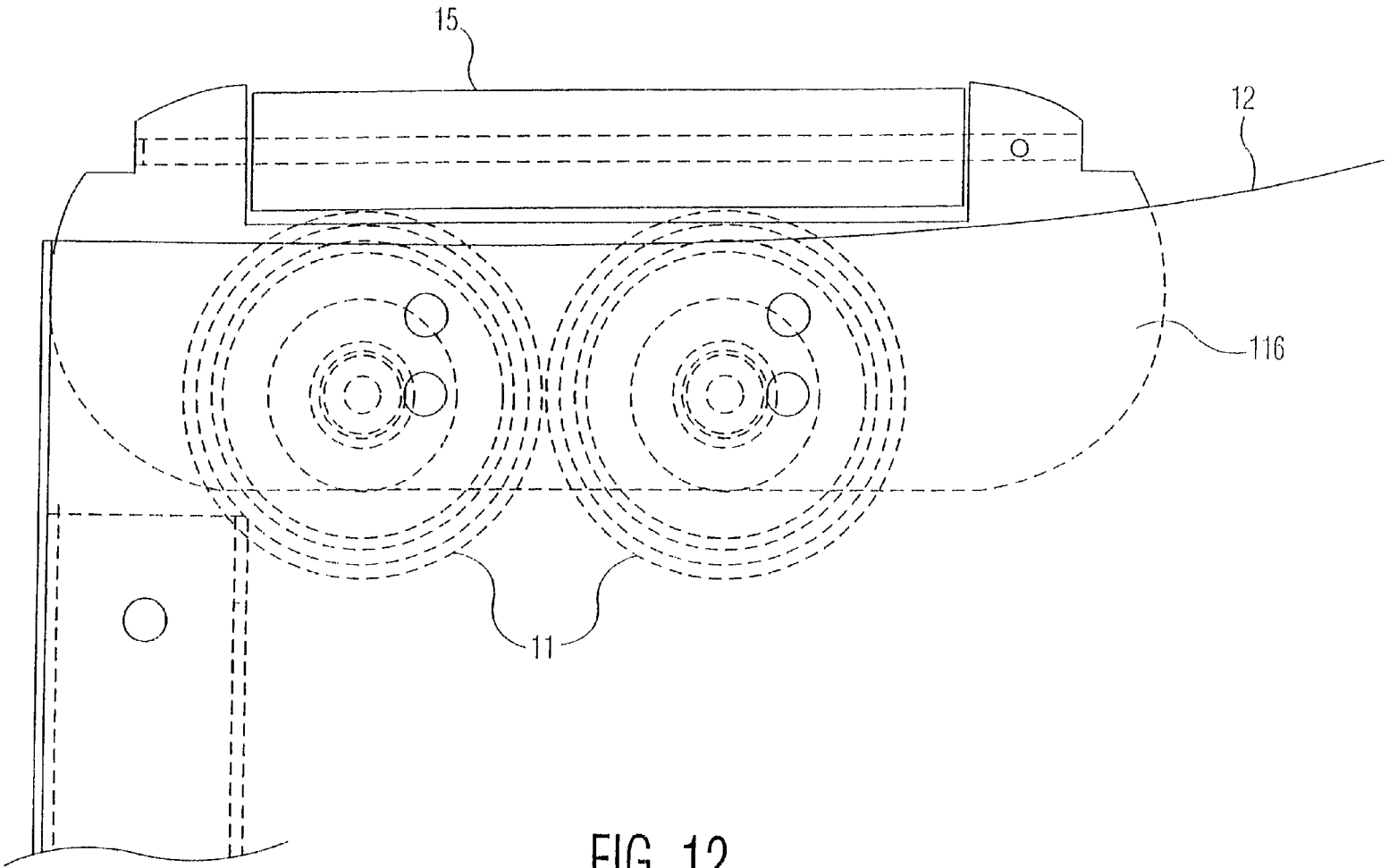
FIG. 12 is an x-ray side view of one pair of pulleys and a roller that is rotatably set in a bracket, which in turn is set in a curved track.

FIG. 12 is an x-ray side view of one pair of pulleys 11 and roller 15 that is rotatably set in bracket 116, which in turn is set in the curved track 12. The other parts depicted have been described in connection with the previous FIGS.

Figure 13:
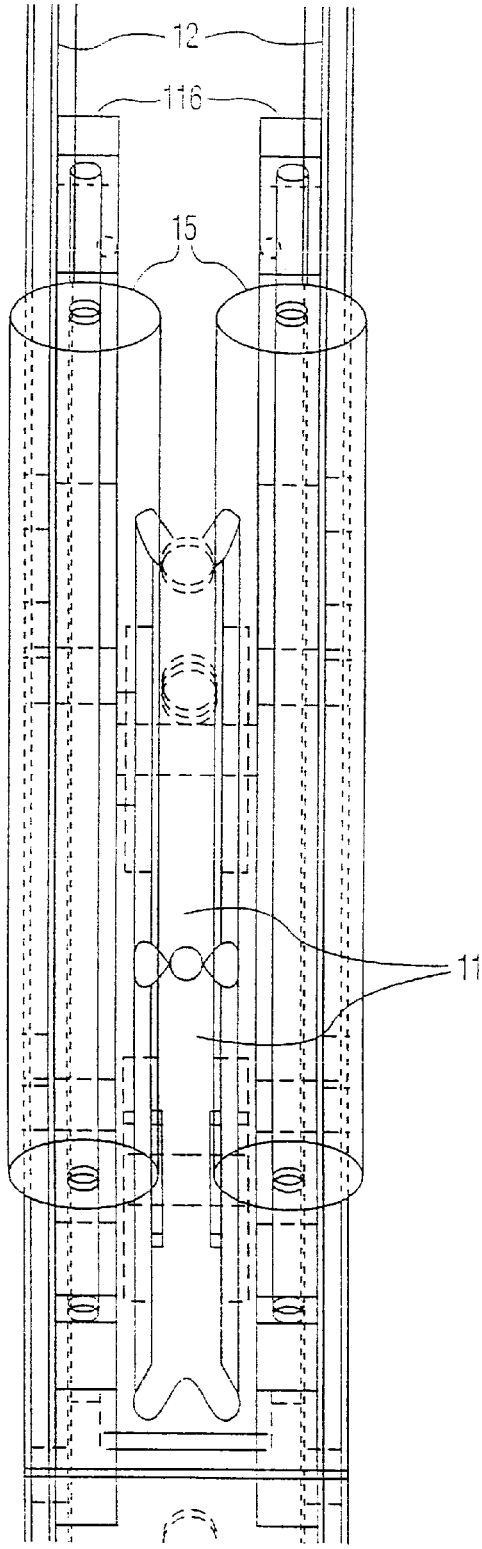
FIG. 13 is an x-ray top view of FIG. 12 showing the rollers over the pulleys.

FIG. 13 is an x-ray top view of FIG. 12 showing the rollers 15 over the pulleys 11. The parts depicted have been described in connection with the previous FIGS.

Figure 14:
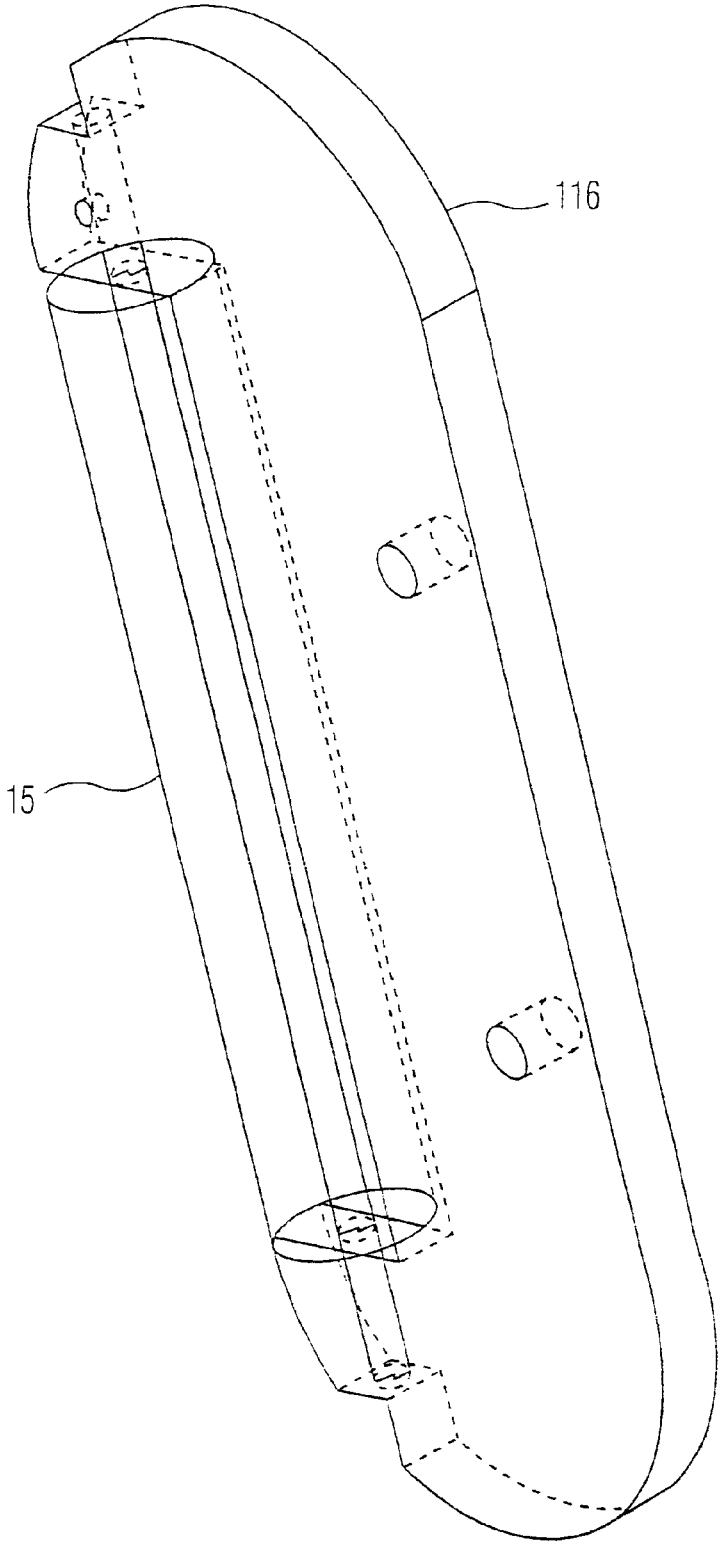
FIG. 14 is an x-ray isometric view of one of the rollers in FIG. 13.

FIG. 14 is an x-ray isometric view of one of the rollers 15 that is shown in FIG. 13. The parts depicted have been described in connection with the previous FIGS.

A system of rollers 15 over the pulleys 11 is shown in FIGS. 12–14 arrangement allows the cable 9 to be pulled from the equipment 10 and routed in any direction (limited only by the equipment body itself) for infinitely positionable resistance training with ease and fluidity while optimizing the intended design of the pulleys 11 themselves which is to have the cable travel along their center axis.

FIGS. 15–18 show a swiveling (vertically approximately 150°) pulley or pulleys 30 in mounting bracket 31.

Figure 15:
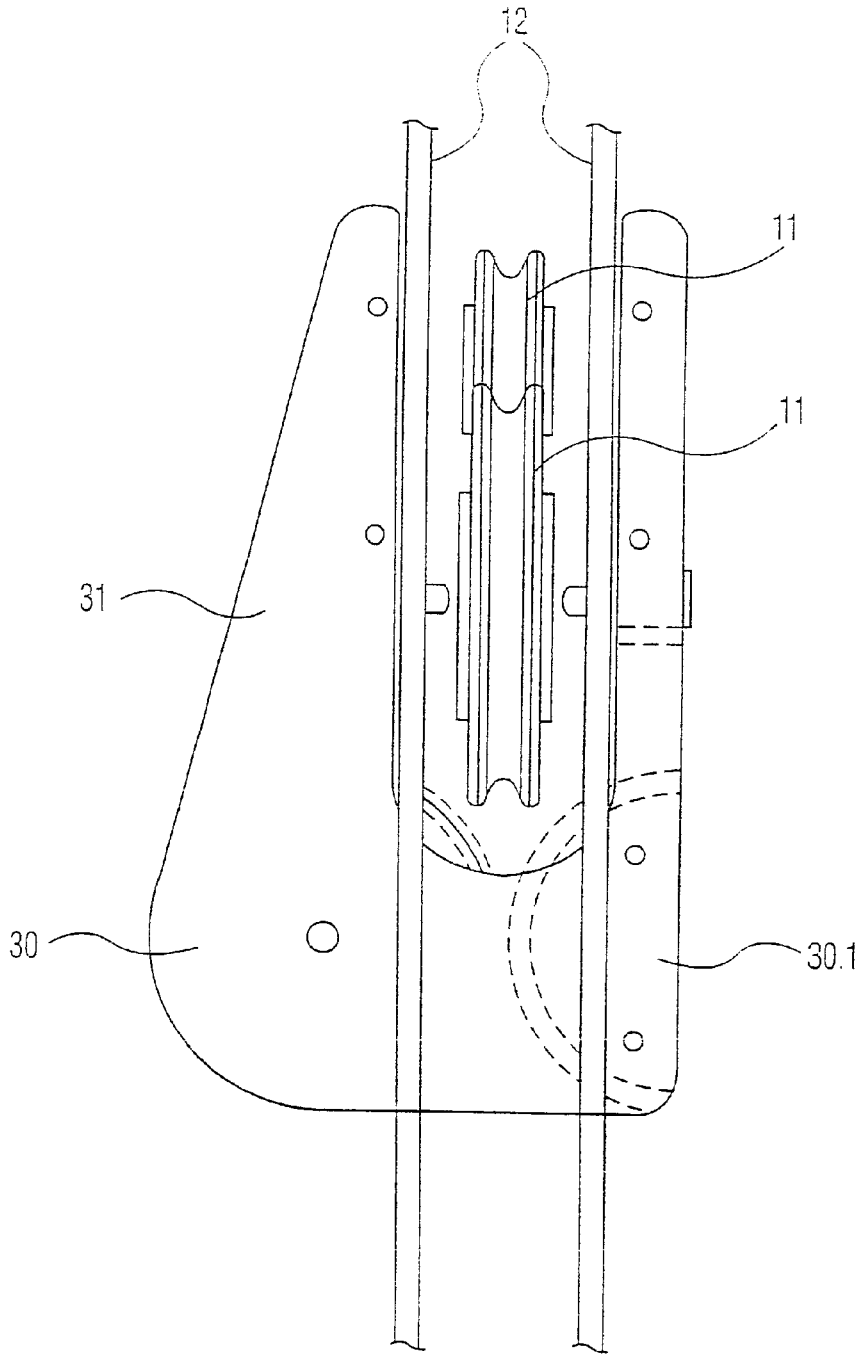
FIG. 15 illustrates an x-ray top view of FIG. 12 showing a swiveling pulley with a rub block instead of the rollers over the pulleys shown in FIGS. 12 and 13.

FIG. 15 illustrates an x-ray top view of FIG. 12 showing a swiveling pulley 30 with a rub block 30.1 set in swiveling bracket 31 instead of the rollers 15 over the pulleys 11 shown in FIGS. 12 and 13.

Figure 16:
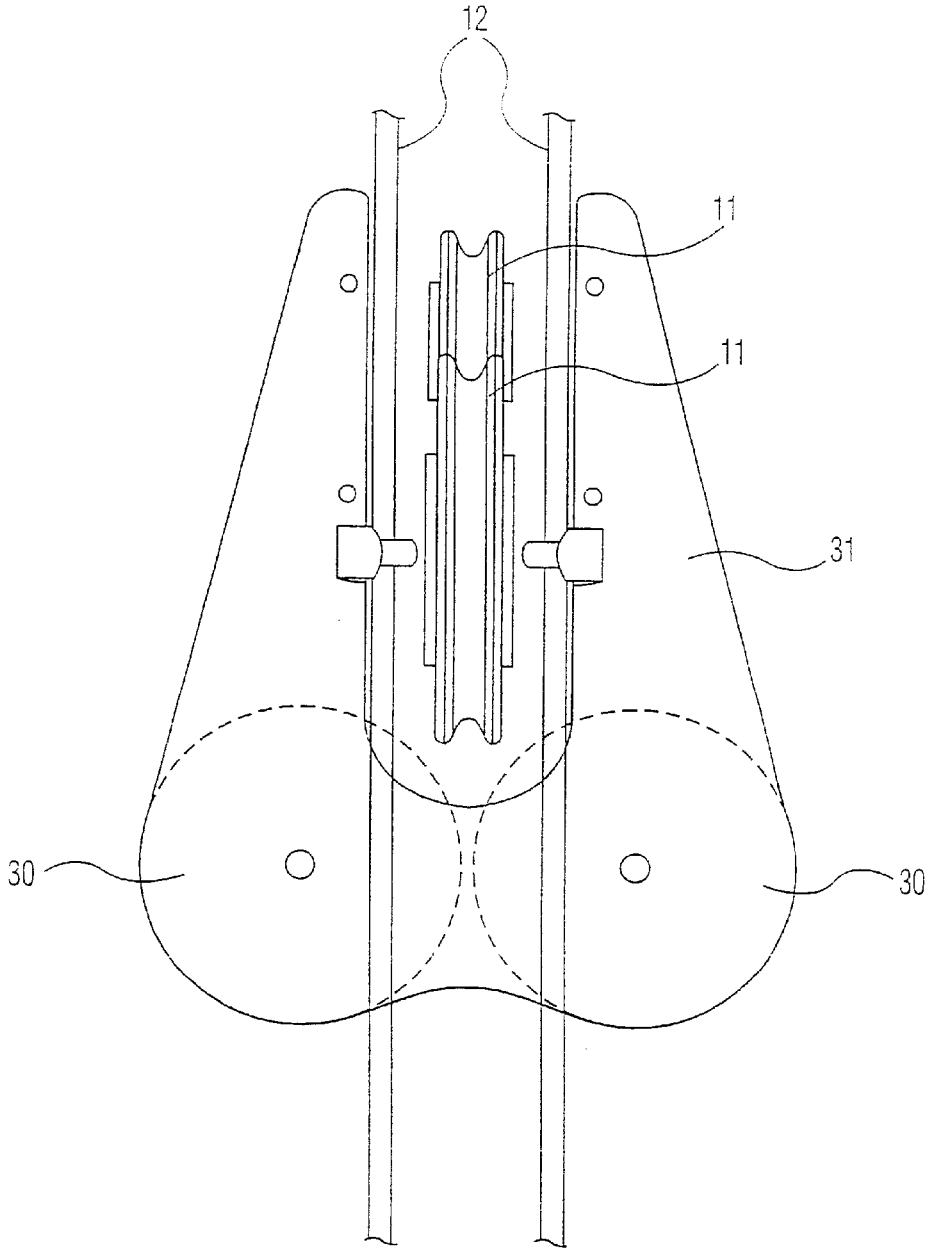
FIG. 16 illustrates an x-ray top view of FIG. 12 showing a swiveling pair of pulleys instead of the rollers over the pulleys shown in FIGS. 12 and 13.

FIG. 16 illustrates an x-ray top view of FIG. 12 showing a swiveling pair of pulleys 30 instead of the rollers 15 over the pulleys 11 shown in FIGS. 12 and 13.

Figure 17:
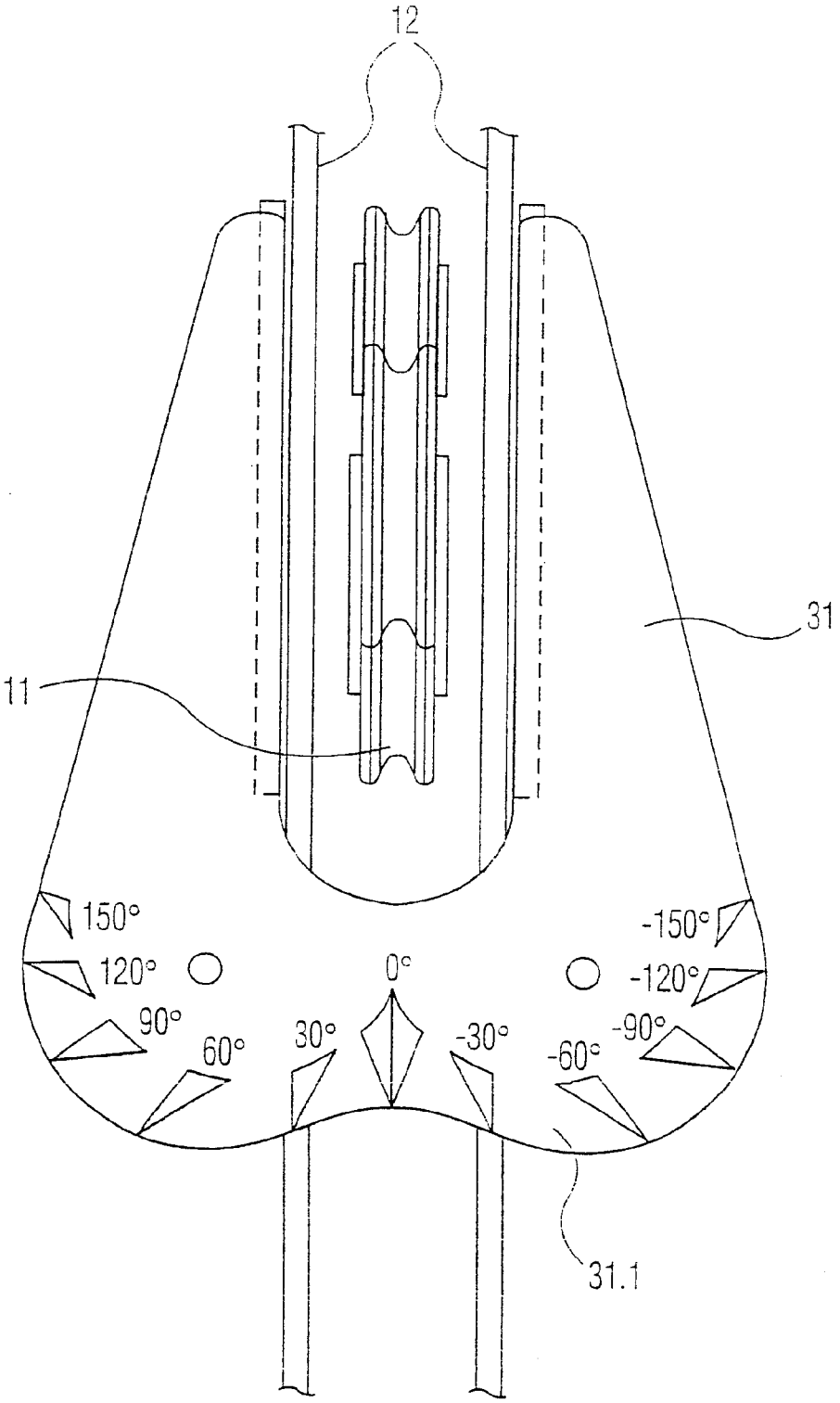
FIG. 17 shows a modification of the embodiment of FIG. 16 with a dial to indicate the angle left or right that the cable is pulled from the equipment.

FIG. 17 shows a modification of the embodiment of FIG. 16 with a dial 31.1 to indicate the angle left or right that the cable 9 is pulled from the equipment 10.

Figure 18:
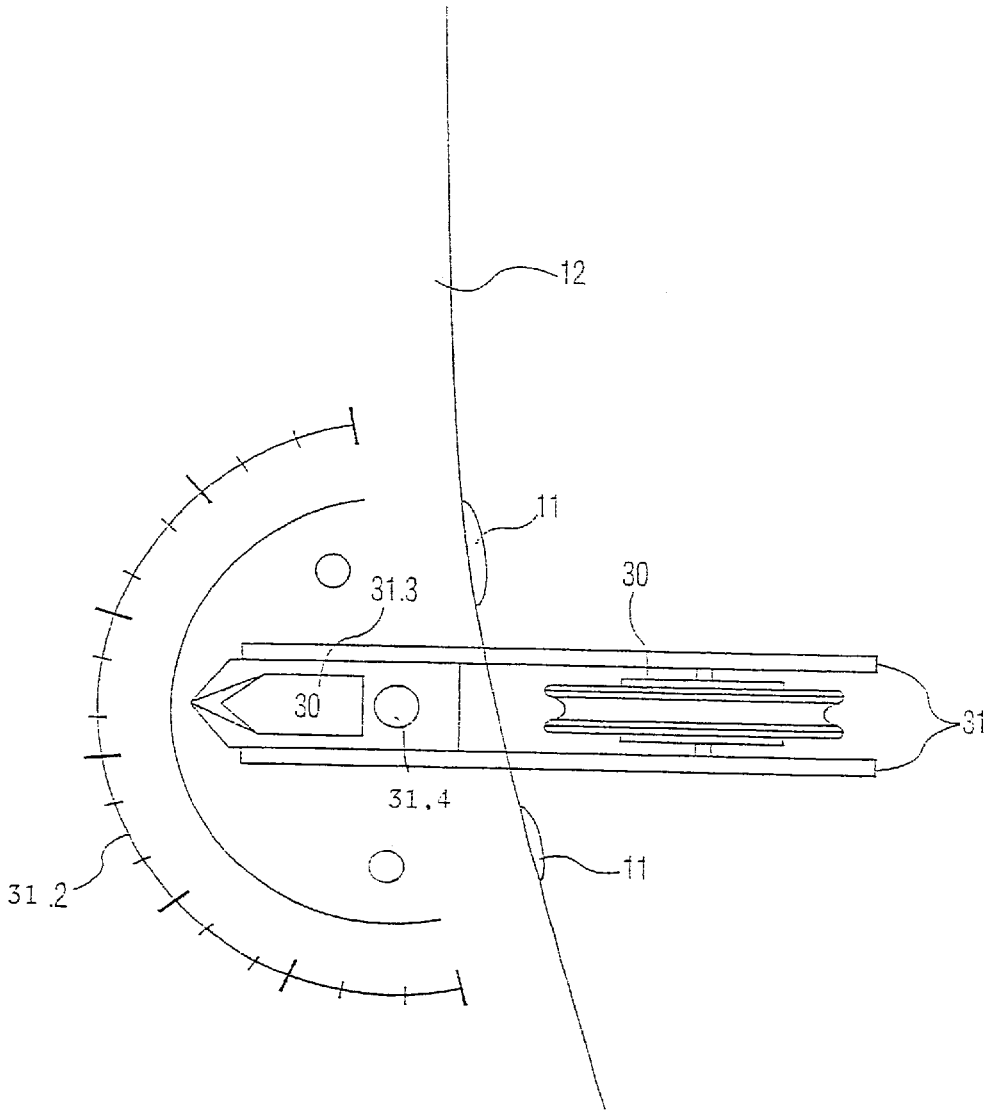
FIG. 18 shows the swiveling pair of pulleys of FIG. 16 with a dial to indicate the angle up or down that the cable is pulled from the equipment.

FIGS. 16–18 show a the swiveling pair of pulleys 30 with a dial 31.2 to indicate the angle up or down that the cable is pulled from the equipment and indicator 31.3 to indicate the egress point along the arced track the cable 9 is being pulled from. This pair of pulleys, which is intended to replace the rollers 15, are mounted on, and can swivel about, pivot point 31.4, and can thus follow the cable as it exits the machine. The other parts depicted have been described in connection with the previous FIGS. This arrangement allows for the use of a unique vector marking, reading and monitoring system (VMRMS) which is inherent in this invention. To get an accurate reading one needs a compass or numeric marker system placed at or near the three points of pulley 11 orientation. It needs to allow the user the ability to record all three vector ranges of movement the cable 9 traveled through while performing the workout. This is comprised of four steps: 1) Select the attachment; 2) Orient one's self and the desired body part one wishes to train relative to the proper egress point; 3) Pull the cable 9 through the desired motion path; and 4) Look at the reading markers and record the point along the arc from which one pulled; namely the horizontal vector range the cable passed through and the vertical vector range. This marking system and recording method can be applied to many of the three-dimensional pulley/cable training systems now on the market which use an extended arm method that rotates a swiveling pulley mounted at the egress end and pivots the other end on a point attached midway up the housing of the resistance. The unique vector marking/reading and analysis system of the invention can also be applied to these devices as well by placing them at the three points of axis. Yet, the design of the invention further optimizes the use of the vector monitoring reading measuring system (VMRMS) and makes its use more practical and easier so that the curved track itself, whether on the multiple fixed point systems or the movable trolley systems, acts as a compass itself. Therefore when the desired egress point is selected all three markings from which to obtain the reading are immediately disposed next to each other. This is advantageous in that the user can see all three readings simultaneously during the movement of the exercise, making tracking, recording and monitoring easier. This system lends itself to even further advancements by the addition of sensors to the pair of pulleys 11 and cable 9 that record and display the speed and directional readings.

Figure 19:
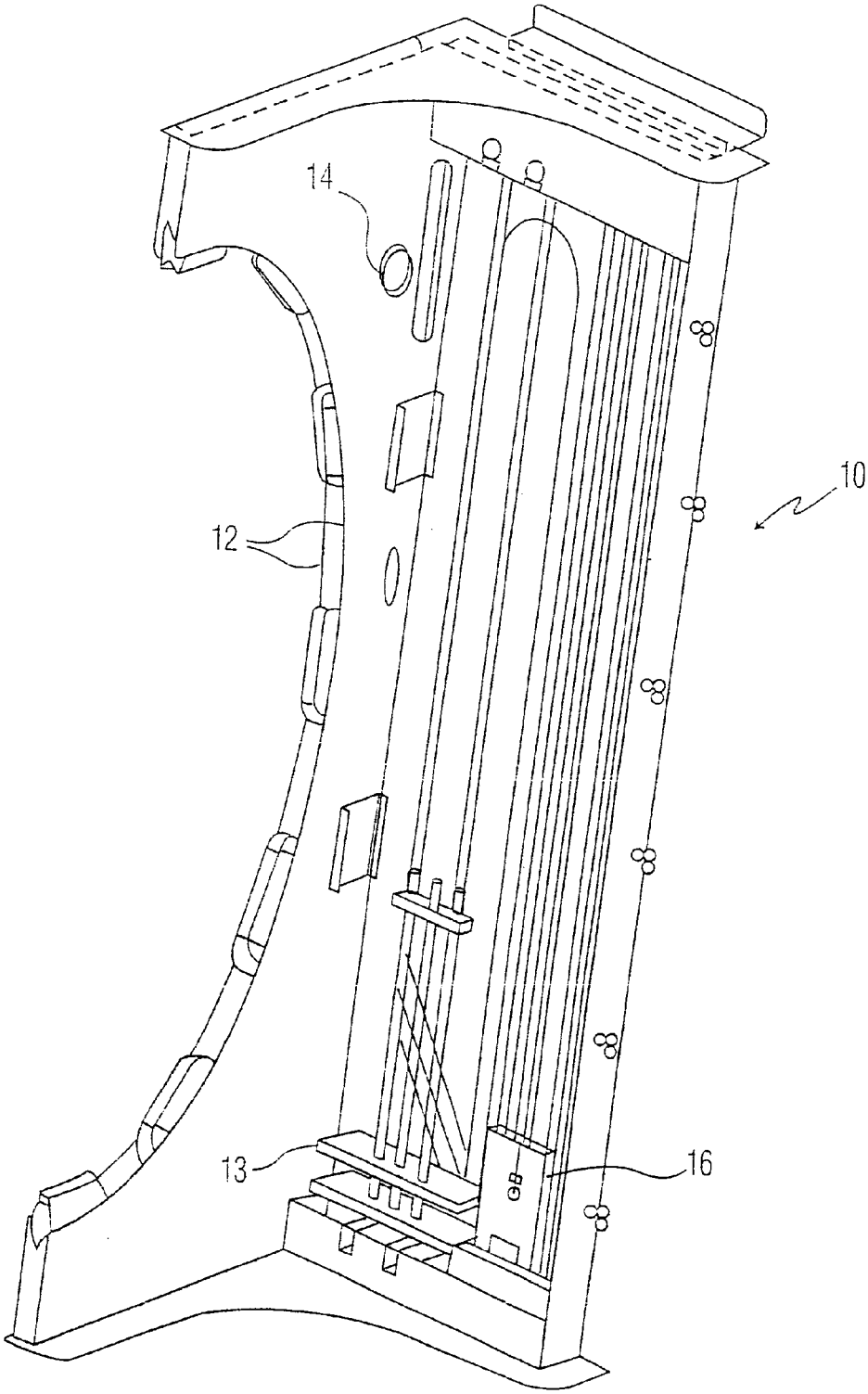
FIG. 19 is another x-ray top isometric view of the exercise equipment constructed in accordance with the present invention.

FIG. 19 is another x-ray top isometric view of the exercise equipment 10 constructed in accordance with the present invention, wherein the parts have previously been described.

FIGS. 20 to 24 illustrate one example of optional ancillary equipment that may be used with the exercise equipment 10 of the invention.

Figure 20:
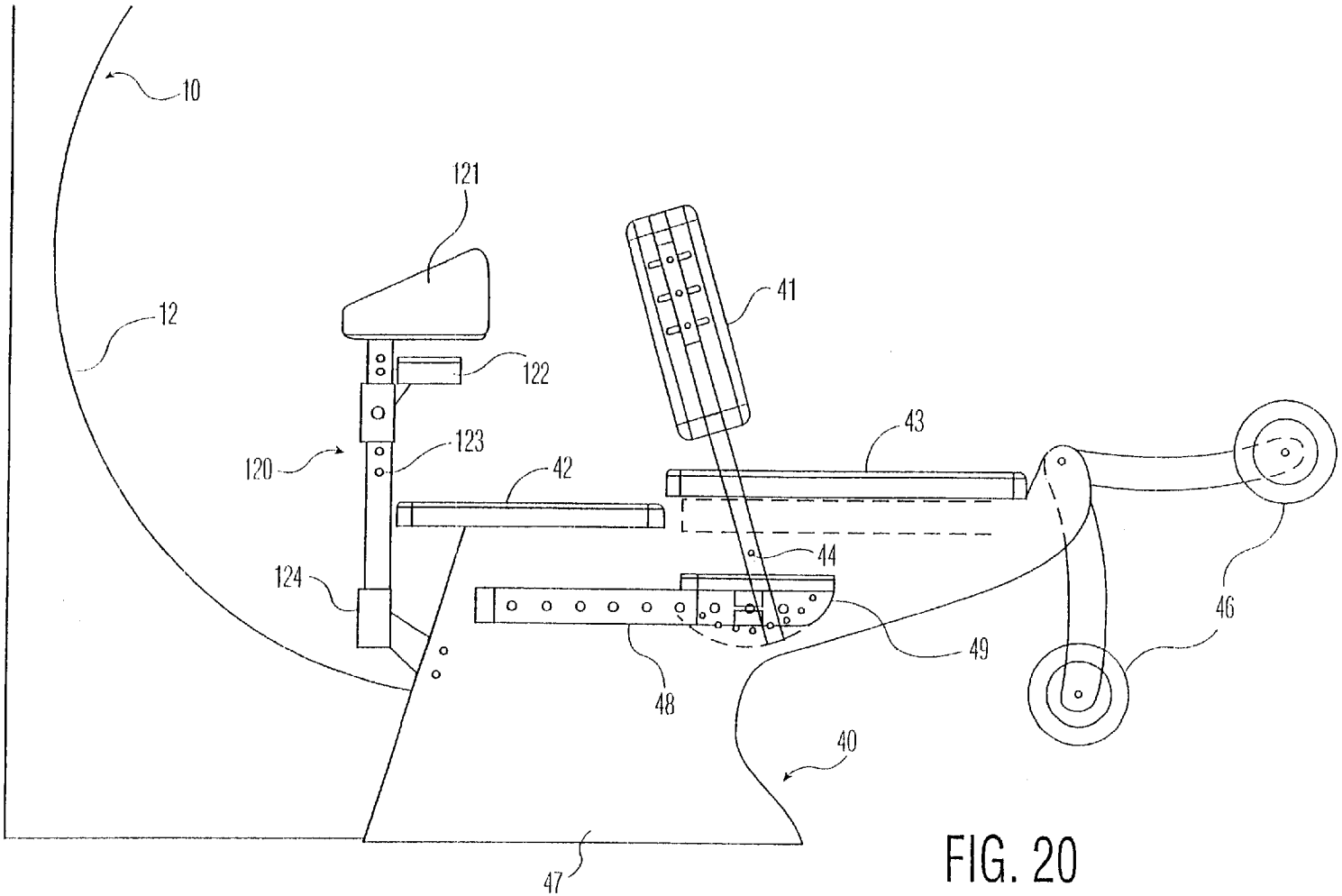
FIG. 20 is an x-ray side view of a multipurpose chair or bench that is an optional feature of the equipment shown attached to the exercise equipment of the invention.
Figure 22:
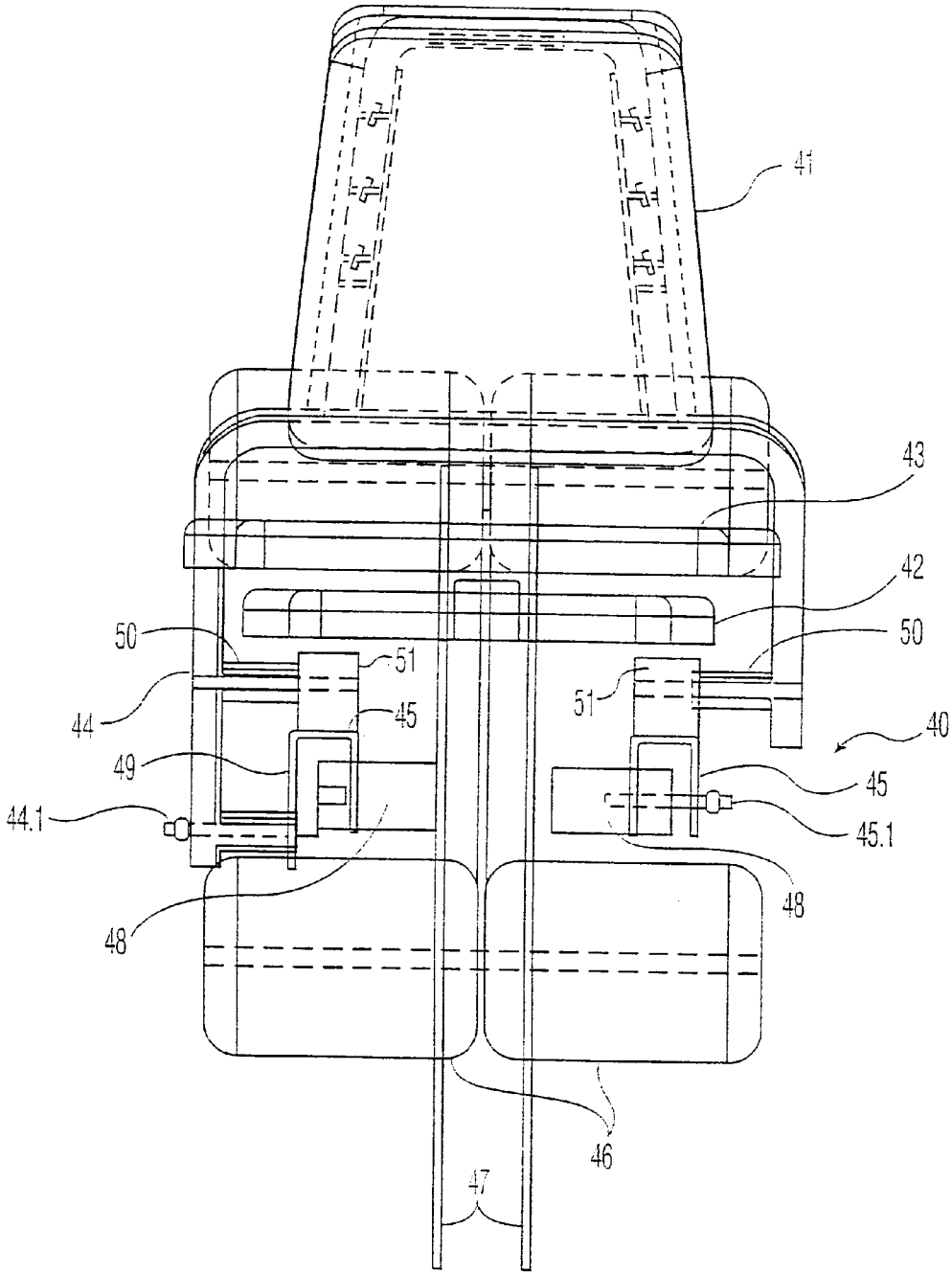
FIG. 22 is an x-ray front view of the multipurpose chair or bench shown in FIG. 20.

FIG. 20 is an x-ray side view of a chair or bench 40 that is an optional feature of the equipment 10 shown attached to the exercise equipment 10 of the invention. Chair or bench 40 is shown with cushion 41 in the upright or chair position. When cushion 41 is positioned horizontally over cushion 42, it forms a bench with seat cushion 43. The cushion 41 may be adjusted horizontally by moving cushion 41 back and forth and securing it in the desired position by inserting a pin 45.1 in an adjusting hole in member 45 and horizontal adjustment bar 48 (as shown in FIG. 22). The angle of cushion 41 may be changed by pulling pin 44.1 from adjustment means 49 and moving side support members 44 (pivoting about bolts passing through 44 and extensions 50 and pillow blocks 51 attached to member 45) relative to adjustment means 49 and then inserting a pin 44.1 in the appropriate holes in parts 44 and 49 (as shown in FIG. 22). All of parts 41 to 46 and 48 to 51 are directly or remotely attached to its frame members 47. As is best illustrated in FIG. 23, the leg extension pads 46 are pivoted centrally in front of the seat cushion 43.

Figure 21:
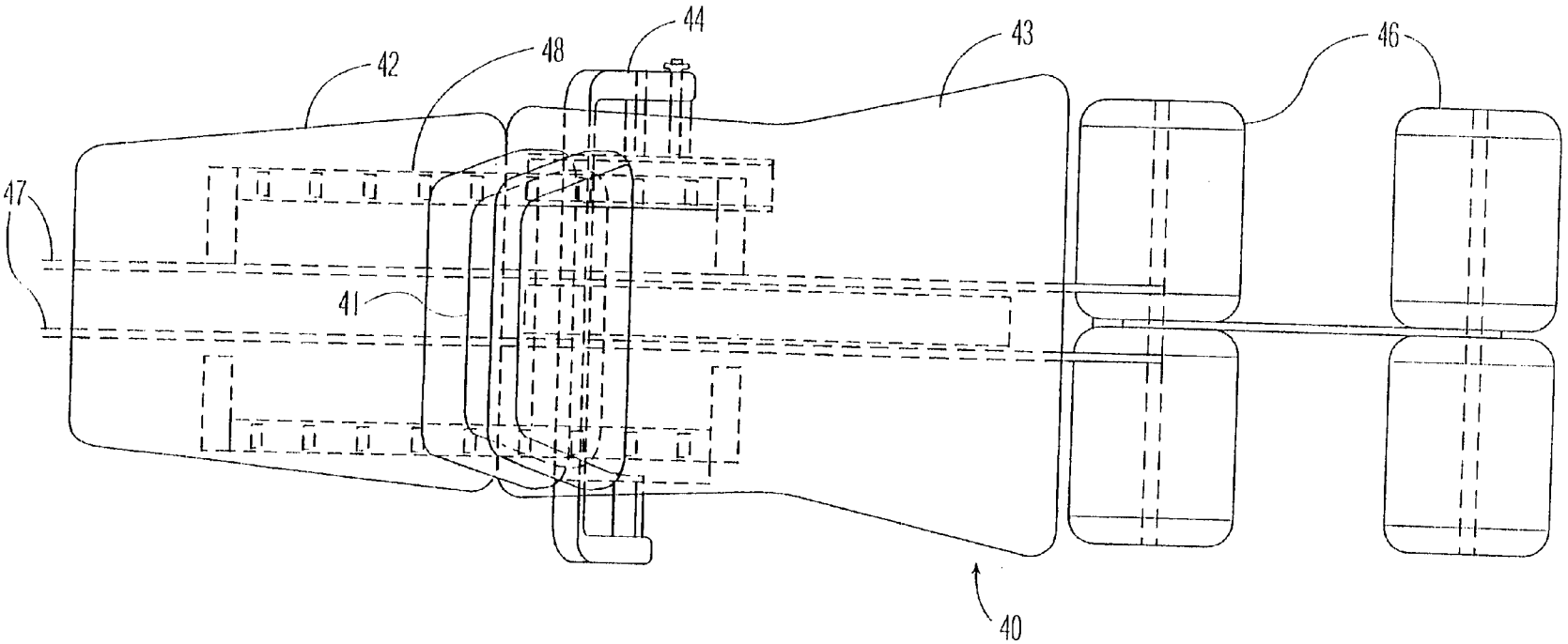
FIG. 21 is an x-ray top view of the multipurpose chair or bench shown in FIG. 20.

FIG. 21 is an x-ray top view of the chair or bench 40 shown in FIG. 20.

FIG. 22 is an x-ray front view of the chair or bench 40 shown in FIG. 20 showing how cushion 41 and support members 44 pivot about a set of posts 50 attached to a set of pillow blocks 51 attached to cover plates 45 riding on horizontal adjustment bars 48 mounted on both sides of frame 47, not shown in other FIGS. It also shows how cushion 41 can be adjusted along a horizontal path forward and backward along adjustment bars 48.

Figure 23:
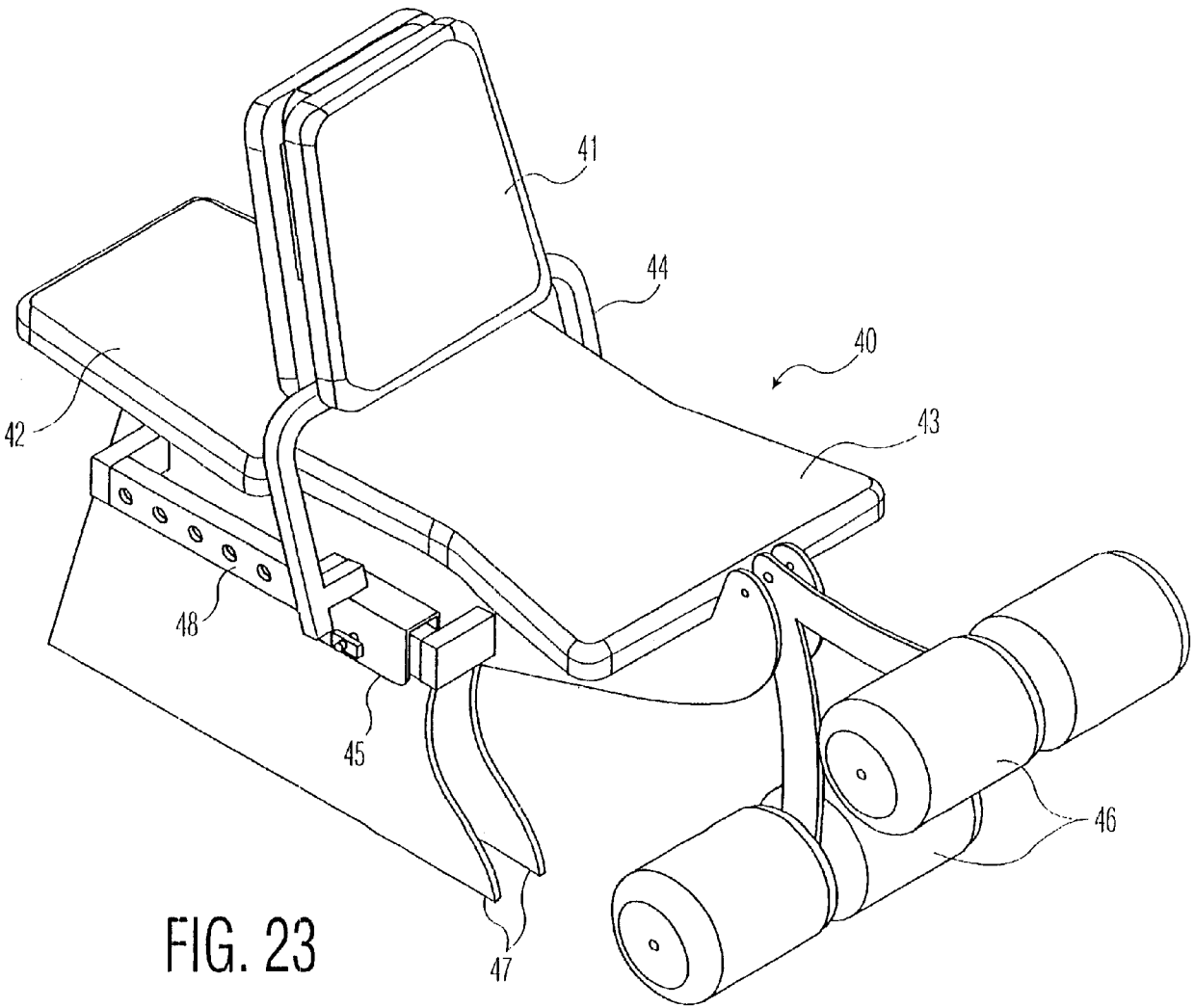
FIG. 23 is a top isometric view of the multipurpose chair or bench shown in FIG. 20.

FIG. 23 is a top isometric view of the chair or bench 40 shown in FIG. 20.

Figure 24:
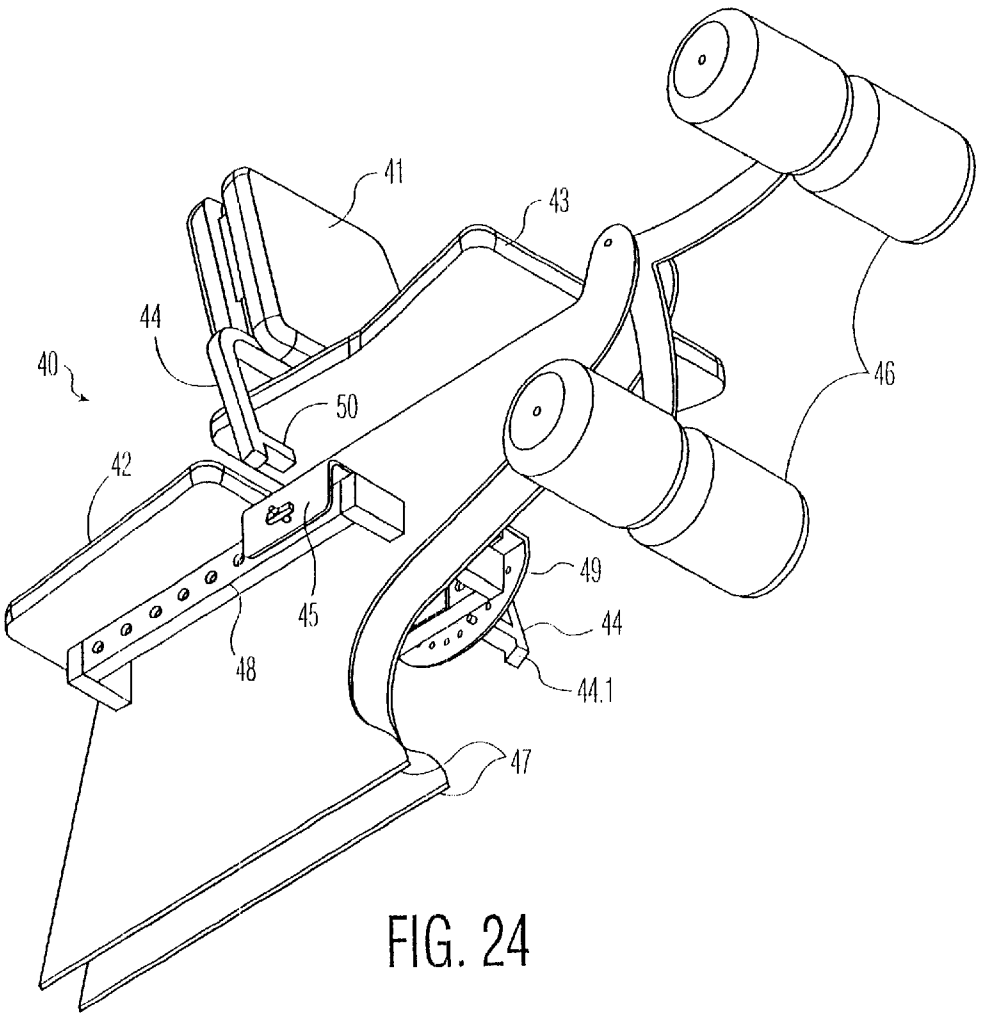
FIG. 24 is a bottom isometric view of the multipurpose chair or bench shown in FIG. 20.

FIG. 24 is a bottom isometric view of the chair or bench 40 shown in FIG. 20.

Figure 25:
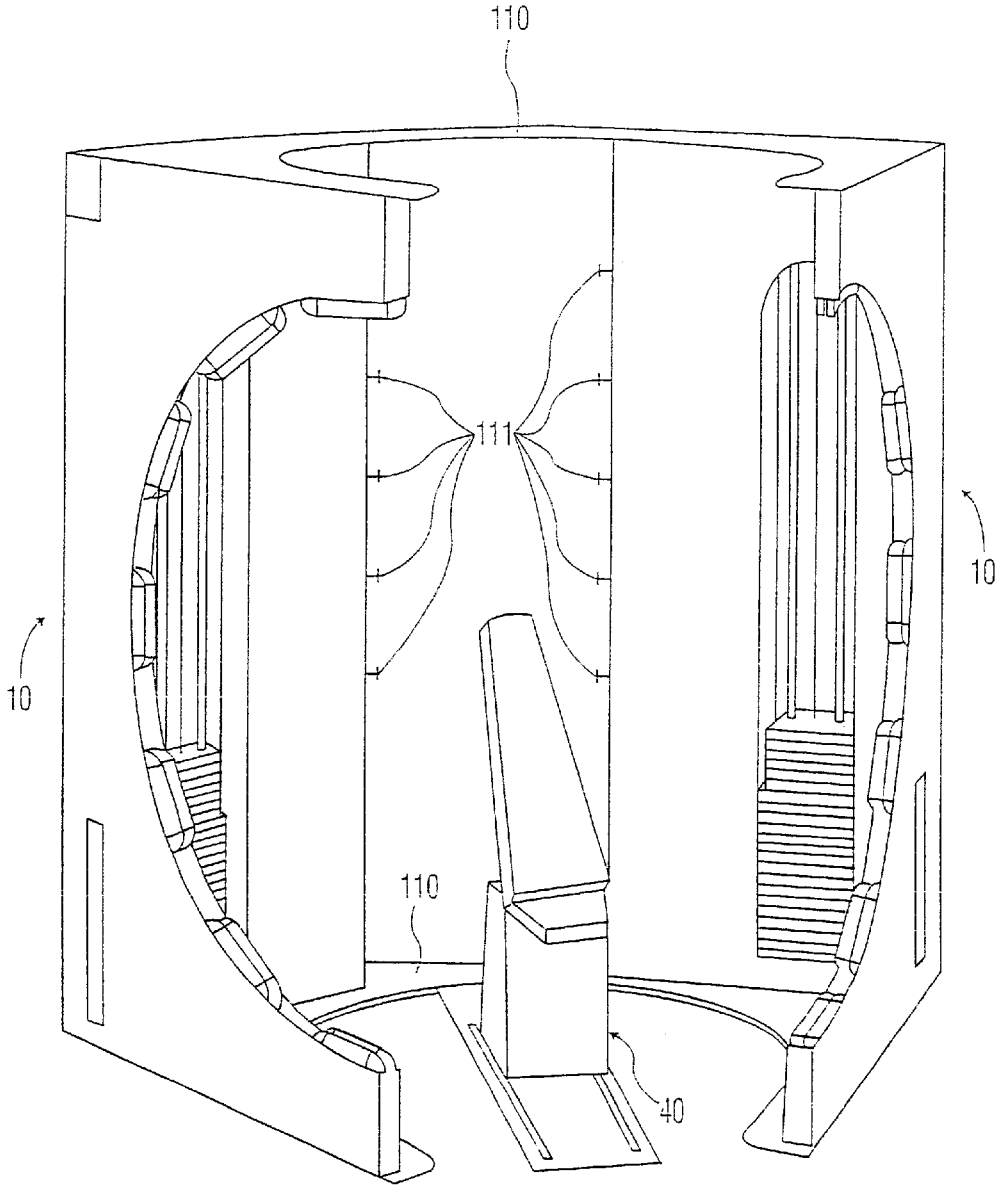
FIG. 25 illustrates two units of the equipment of the invention joined together with an adjustable and repositionable bench positioned between them. There is also a series of small hooks or posts 111 that serve as a built-in rack for holding different attachments, handles, bars and grips.

FIG. 25 illustrates two units of the equipment 10 of the invention joined together through intermediate connectors 110 with bench 40 positioned between the units, and posts or hooks 111 which are used as a rack for holding handles, grips, bars and other attachments. These units, which are placed side by side, can be arranged at any selected relative angle.

Figure 26:
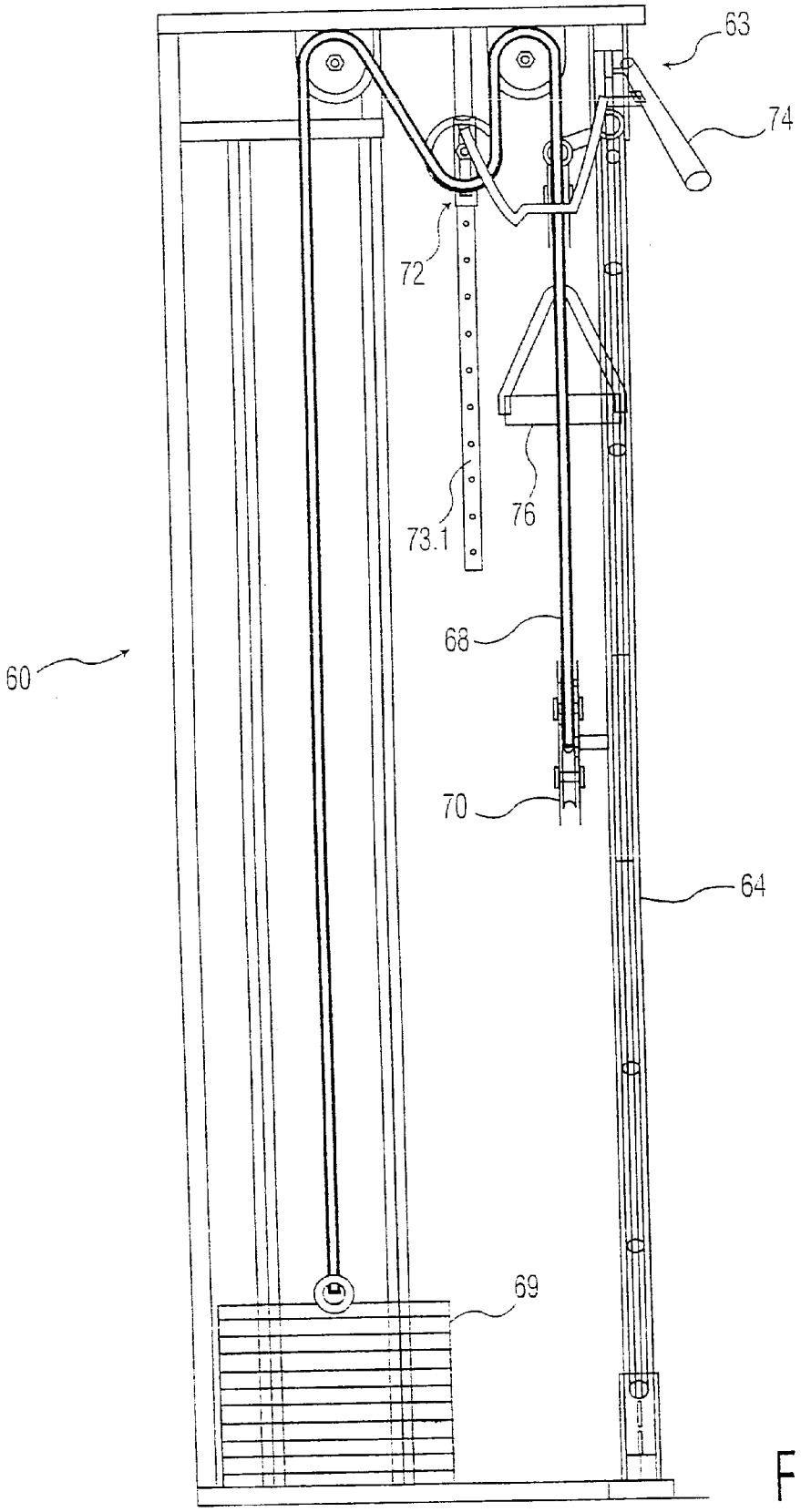
FIG. 26 is a front view of an economy model of the invention, which has a single cable.
Figure 27:
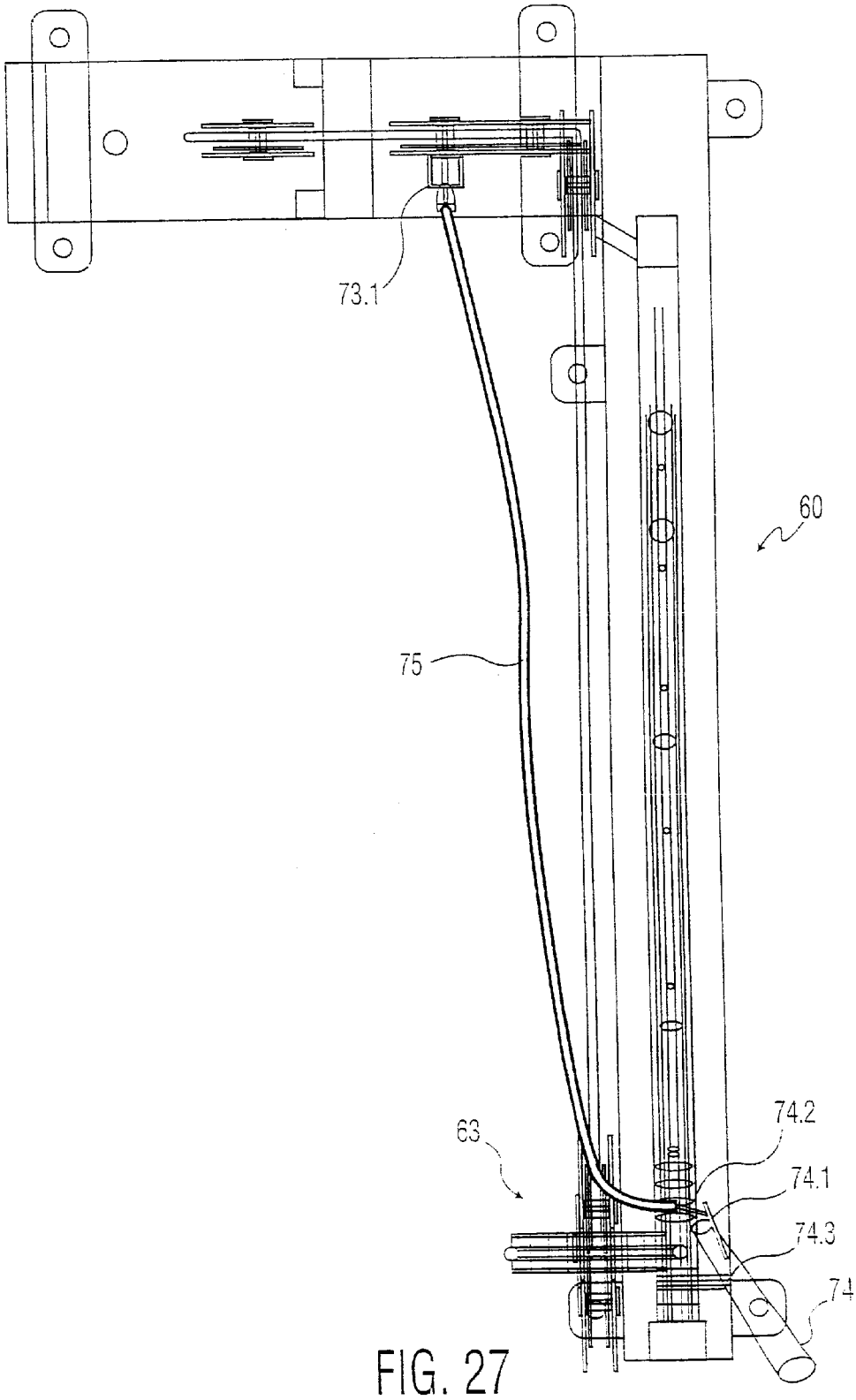
FIG. 27 is a top view of the economy model depicted in FIG. 26.

Movable trolley equipment 60 is shown in FIGS. 26 to 31. FIGS. 26 and 27 show only selected parts of equipment 60

FIG. 26 is a front view of an economy model 60 of the invention, which has a single cable 68. The movable trolley equipment 60 has a curved track 64. Single cable 68 is connected to a resistance means 69 (depicted here as a weight stack, but could be another form of resistance) and then routed by a series of pulleys, collectively indicated as 70. The movable trolley system 63 of the invention preferably has a one-step system for repositioning the housing 61 and taking up the cable slack by simultaneously activating cable take up means 72. There is a one-step release mechanism/lever 74. The proximal end of cable 68 is connected to the attachment 76 (shown as a handle, but could be any number of different attachments as shown in FIG. 3).

FIG. 27 is a top view of the economy model 60 depicted in FIG. 26. There is a one-step release mechanism/lever 74, brake cable 75 and movable trolley system 63.

To actuate the one step system shown in FIGS. 26–31, lever 74 is pulled inward (to the left) causing it to rotate on pivot connection 74.3 acting as a fulcrum. The end of 74 is attached to pin 74.1 and to the end of a flexible sheathed cable 75. When lever 74 is pulled inward it pulls the pin 74.1 out of positioning hole 74.2 on housing 61 and out of positioning hole 64.2 located on curved flat bar 64.1 within the housing 61 traveling along curved flat bar 64.1 and curved round bar 64, thus freeing it up for repositioning movable trolley system 63 and egress point 67 along the curved track. Simultaneously, brake cable 75 is pulled outward from housing 61 (shown in FIG. 28) causing the pin in brake 73 to retract from corresponding repositioning holes along vertical bar 73.1 (shown in FIG. 30). Slack in cable 68 is caused when movable trolley system 63 is repositioned along the curved track. Thus, cable take-up mechanism 72, acting as a counterweight (instead of a counterweight, a spring, elastic cord, electronic take-up means or a winch may be used) comprised of a pulley 72.1 (shown in FIG. 28) wherein cable 68 is routed through pulley system 70 to the under side of pulley 72.1 then to the resistance means 69 shown here as a weight stack, moves vertically up or down to take out the slack in the cable 68. Pulley 72.1 is mounted on a hollow housing 72.2 with bushings or rollers within (bushings or rollers not shown) (or can be a pulley mounted on a movable housing that can travel in a substantially vertical direction on any number of various track, rods, tubes, shafts or bars) and set to travel along vertical bar 73.1 set within the housing 72.2. The cable take-up mechanism 72 travels in a substantially vertical direction up or down in direct proportion to the distance the movable trolley system 63 is moved along the arced curve. Once the new position is found for the moveable trolley system 63 the lever 74 is pushed outward causing pin 74.1 and brake pin 73 to simultaneously slide into their corresponding holes locking them in place along curved rod 64, curved flat bar 64.1 into holes 64.2 and holes in vertical rod 73.1 respectively.

The brake 73 and cable take-up means 72 as well as the moveable trolley system 63 can be applied in both a fixed end and a closed loop cable system. Brake 73 can also be used when the cable take-up means 72 is between the egress point 67 and the resistance means 69, or past the end of the resistance means 69 as shown in U.S. Pat. No. 5,102,122.

Figure 28:
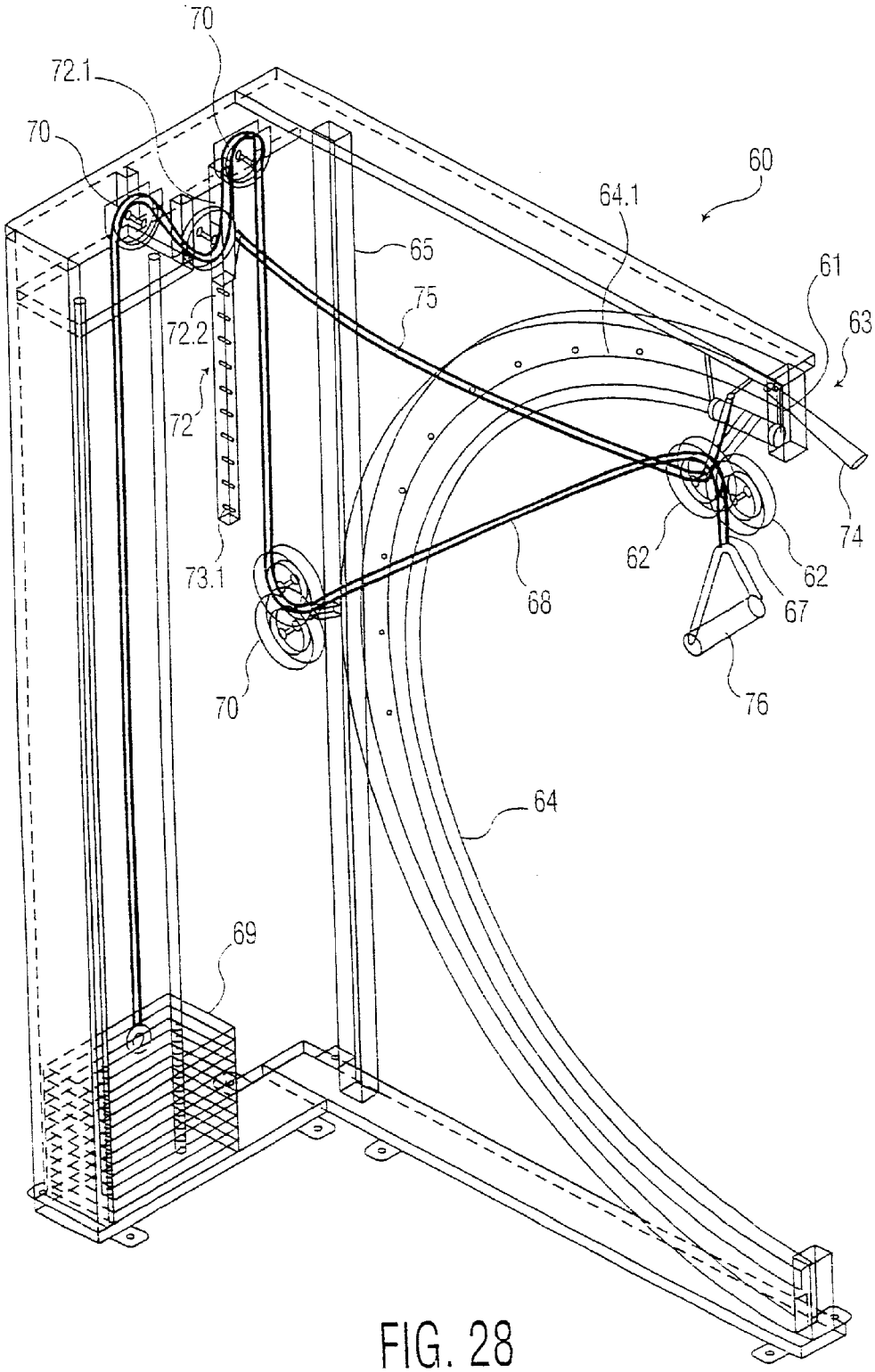
FIG. 28 is a left isometric view of the model of FIG. 26.

FIG. 28 is a left isometric view of the model 60 of FIG. 26. The movable trolley equipment 60 allows for one step to reposition a movable trolley system 63 comprised of a housing 61 shown here to contain a pair of bushings 61.1 fixed within it (yet could be made of a housing with rollers, bearings or other gliding means) and a one-step release/lever 74 and a brake mechanism comprised of parts 74.1–74.3 (shown in FIG. 27) to reposition the movable trolley system 63. The housing 61 can be positioned along a curved track shown here as curved rod 64 and curved flat bar 64.1 running parallel to each other and having an equally spaced slot between them (yet could be made of other combinations of rods, bars, tubes or tracks having housing with rollers, bearings or other gliding means traveling upon them or a solid track with a movable trolley affixed). This allows the use of a sturdy, less expensive frame 65 and a curved track for the movable trolley system 63 to move along to relocate an egress point 67 for the proximal end of a cable 68 the distal end of which is connected to a resistance means 69 (depicted here as a weight stack, but could be another form of resistance) and then routed by a series of pulleys, collectively indicated as 70, through a cable take-up means 72 to two parallel pulleys 62 located on the movable trolley system 63. The user can weight train with both light and heavy resistances in infinitely variable resistance planes.

The movable trolley equipment 60 of the invention preferably has a one-step system for repositioning the movable trolley system 63 and taking up the slack in cable 68 by simultaneously activating cable take up means 72. Such a one-step system has a mechanically or electronically actuated brake 73 (shown in FIG. 30) using levers, cables, pins, pads, or other braking means that is activated when the one-step release mechanism 74 shown as a lever but could be a knob, handle, push- button or other actuating means for repositioning the movable trolley system 63 is used. When the mechanism comprised of 74–74.3 and brake cable 75 to unlock housing 61 is activated, the brake 73 at the distal end of brake cable 75 is simultaneously released on the cable take-up means 72 which acts as a counterweight. Instead of a counterweight, a spring, elastic cord, electronic take-up means or a winch may be used. When the movable trolley system 63 is repositioned and locked in place along curved track and affixed in place by one of the positioning holes 64.2, the brake 73 is simultaneously locked onto the vertical bar 73.1 by its corresponding positioning hole. The brake cable 75 and one-step cable take-up mechanism 72 are oriented in such a way that when the housing 61 is moved along the curved track, the length of the cable 68 remains constant with regards to the egress point 67 and the proximal end of cable 68 that connects to the attachment 76 (shown as a handle). When the housing 61 is unlocked, the brake73 (as seen in FIG. 30) is simultaneously unlocked, allowing the cable slack to be taken up by cable take-up mechanism 72.

Figure 29:
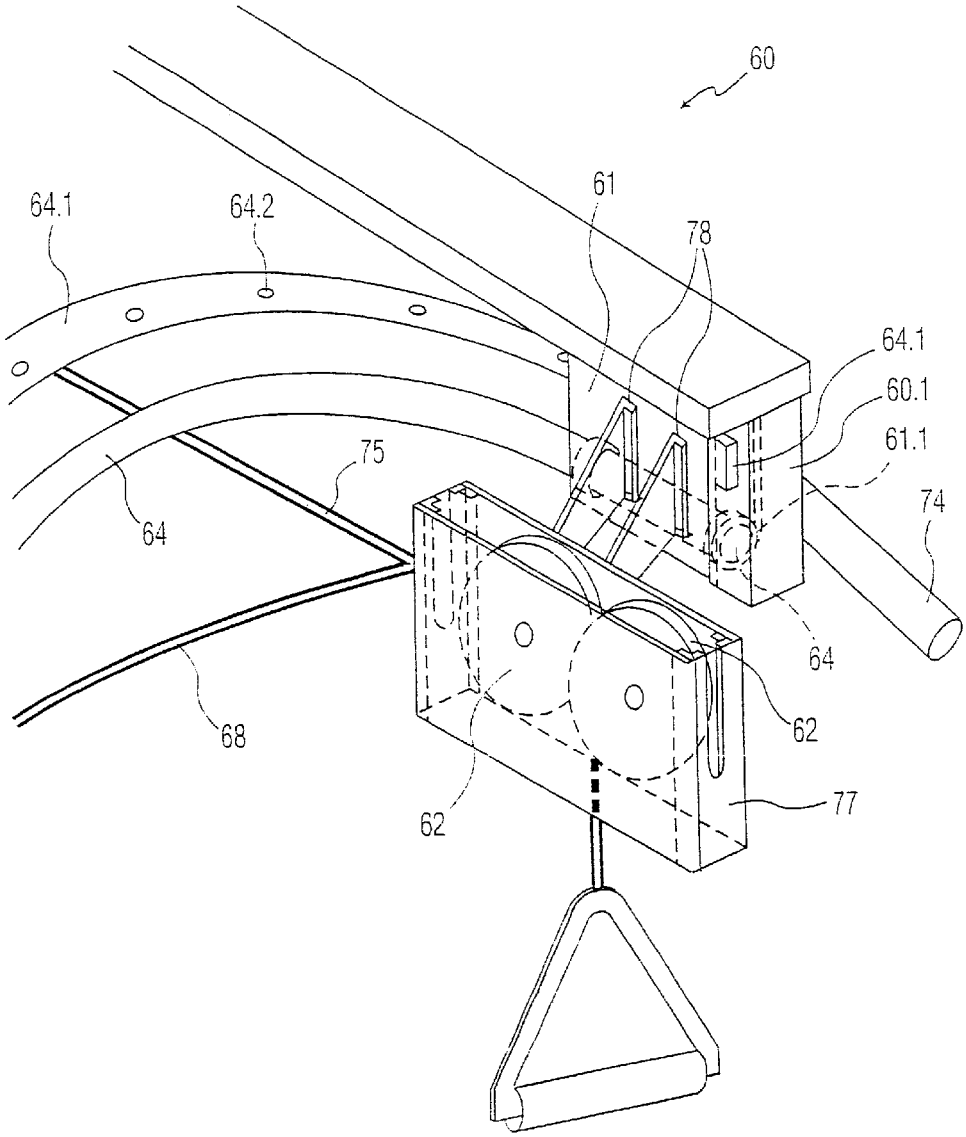
FIG. 29 is an enlarged view of a different version of the trolley shown in FIGS. 26, 27, 28, 30, 30.1 and 31.

FIG. 29 is an enlarged view of an alternative design of the movable trolley system 63 shown in FIG. 28. It illustrates a non-pivoting housing 77 containing pulleys 62 attached by extensions 78 to movable housing 61 and one-step release mechanism/lever 74. Cable 68 passes through slots in the narrow ends of housing 77 and through pulleys 62 as the housing 61 is repositioned along track 64. This non- pivoting housing enables the attachment of pulleys (or pulley) 30 in mounting bracket 31 as depicted in FIG. 16 or pulley 30 and rub block 30.1 in mounting bracket 31 as depicted in FIG. 15 or rollers 15 as depicted in FIG. 13 to be mounted over pulleys 62.

FIG. 30 is a right side view of the model 60 of FIG. 26. It shows a connecting metal brace 65.1 attached to vertical bar 65 and curved flat bar 64.1. The metal brace 65.1 serves to keep the curved track in line when resistance is applied during use of the exercise equipment 10.

FIG. 30.1 is an enlarged view of part of the model 60 of FIG. 30. It shows pulleys 62 mounted to a bar 62.1 attached to a pivoting point 62.2 attached to the end of support bracket 61.2 which, in turn, is attached to housing 61. Cable 68 can pass between pulleys 62 thus allowing the user to be able to pull on attachment 76 in any direction as the pulleys pivot about point 62.2, limited only by the body of the frame 60.

Figure 31:
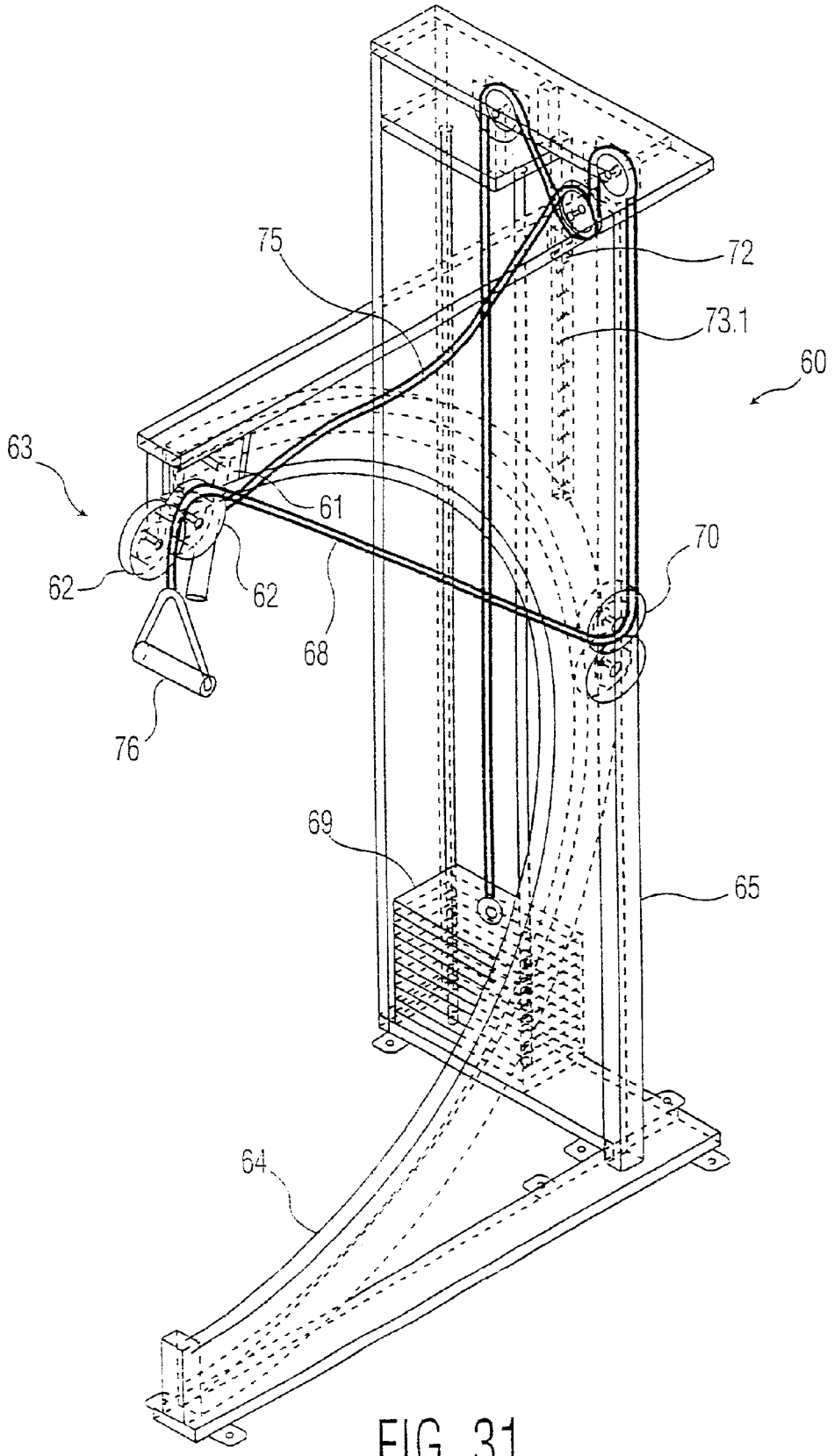
FIG. 31 is a right isometric view of the model of FIG. 26.

FIG. 31 is a right isometric view of the model 60 of FIG. 26.

The movable trolley system of the invention is more conventional in its fabrication, preferably using welded square tubing as its frame and exposing more of the inner workings of the equipment as do many cable-cross units of equipment currently on the market which are made with sturdy enough materials and careful design as to minimize the risk of snapping cables and pinching extremities. However, its overall design is unique due to the use of the curved track (made up in this version of a curved round bar 64 and a curved flat bar 64.1 but could be made of other combinations and forms of curved rods, bars cylinders or tubes) and the one-step cable take up system 72 and the movable trolley system 63. Its safety is increased. The movable trolley system of the invention provides most, if not all of the benefits of the fixed egress system of the first preferred embodiment of this invention.

Other devices that use repositionable pulley egress points use pulleys located within swiveling housings wherein the housing swivels around a vertical bar or at the end of an extended moveable arm. Such swiveling systems can be used fairly well on a curved system a shown in FIGS. 26–28 and 30–31. A better method is to use a single pulley or a set of fixed double pulleys which can be fixed in a side wall as shown in the multiple egress system of the invention or a set of fixed double pulleys which can be fixed in a housing which runs parallel to the curve and is mounted on a trolley (as seen in FIG. 29). Such fixed systems can then use the pulley (or pulleys) 30 in mounting bracket 31 swiveling left or right approximately 150° as depicted in FIG. 16 or rollers 15 in FIG. 13 over the pulleys 11. This arrangement allows the cable to be pulled from the equipment and routed in any direction (limited only by the equipment body itself) for infinitely positionable resistance training with ease and fluidity while optimizing the intended design of the pulleys themselves, which is to have the cable travel along their center axis. This arrangement also allows for the use of a unique vector marking, reading and monitoring system (VMRMS), which is inherent in what is claimed in this invention.

Both retain the biomechanical advantages of the curve and pulley/cable resistance delivery system providing resistance in three-dimensional space, are aesthetically pleasing and unique in product styling, offer ease of use and understanding, offer wheelchair accessibility, have the ability to preset or easily reset the attachments and the sequence of various exercises and provide a minimum number of adjustment steps, provide an infinite number of training possibilities, provide faster and safer workouts, are intuitively understood, provide economies of scale for manufacturing, have a means to record and monitor exercises in three-dimensional space, provide a 360 degree workout environment and can service a wider range of users Units of equipment known to be in existence today cannot offer all these benefits.

The new moveable trolley system 63 with its one step repositioning system comprised of release mechanism/lever 74 and cable take-up mechanism 72 and brake system 73 takes what otherwise would be a six step process when using the moveable trolley system as is the case with ELGIN and the equipment described in U.S. Pat. No. 5,102,111 (up to twelve in the dual equipment configuration) and breaks it down to one or two steps. The only thing necessary to change often is the means for changing the amount of resistance the user wants. Everything else is made simple.

The Total Body equipment of the invention optimizes both form and function and provides the ability to create diverse product lines utilizing the core concept and virtually identical parts, whereby manufacture of entire new lines of products is made possible by simple combinations of egress points. They also can work in conjunction with specially designed benches, a multi-positionable/multi-functional chair with interchangeable parts and various grips, bars and attachments to create an easily expanded use of the new line of products. This line can be further diversified to meet the needs of specific user groups by reconfiguring and customizing the resistance means with differing iterations of progressive weight resistance. There is no line available today that allows the manufacture of so many resistance units of equipment to be fabricated from the same standard parts allowing for the need for less custom parts, greater efficiencies in production, ease of assembly, ease of shipping and all areas associated with the product's manufacture, yet still delivers many more benefits to the user as compared to resistance training units of equipment currently available.

The units of equipment in the line can be made from standard metal tubing, cables or straps, pulleys and one or more resistance means. They can also be fabricated from parts made out of sheet metal or sheet plastic in conjunction with standard cables or straps, pulleys and resistance means available to create a line of similar characteristics yet having a totally new look and product styling. Such fabrication using almost 100% laser cut sheet material in the frame and housings is unique in that it requires few welded parts, unlike any device currently available, which provide both light and heavy loads of resistance. Standard sets of parts are preprogrammed into the laser, cut as needed, then easily mixed and matched to create an easy to assemble and wide variety of different units of equipment that comprise an easily expandable line.

This unique core design in this field allows for greater ease of manufacture and use of fewer parts yielding the ability to fabricate two or more product series with four or more different product lines in each, with a dozen or more products in each line. Units of equipment made with the movable trolley system or the multiple fixed point system offer many unique advantages over units of equipment currently available. Particularly providing the user the ability to train for muscular development in three dimensional space in such ways that more closely relate to real human movement patters found in real life functions such as playing sports, carrying groceries, getting up and down out of chairs, performing lifting tasks at work, etc. It also allows for those in physical rehabilitation to more easily reach muscle groups that need work, can provide both light and heavier resistance loads which are now measurable and consistent throughout the movement and able to be repeated in three dimensional space. Up until now therapists relied on fixed point, low weight pulley systems or ones that travel along a straight line vertically positioned along side the user; and rubber band and rubber straps fixed to door knobs and wall rods and the like.

Units of equipment with multiple fixed egress points offer another type of improvement over units of equipment currently available. This design eliminates the need for a cable take-up locking mechanism and the added steps of having to unlock then relock the connecting means users have to perform each time when moving to a different point of egress. Similarly, the fixed egress point design is unique in that it eliminates the step of having to constantly reposition the egress point and lock it in place, thereby eliminating another step for the user. It further eliminates steps for the user by allowing a multiple combination of grips, handles and bars to be attached ahead of time, so changing exercises is faster, more efficient and easier. By the addition of two roller 15 arms running parallel to the egress pulleys 11 or 62 and/or the widening of the flange along the point of egress on the egress pulleys 11 or 62, or by adding a swiveling pulley 30 in front of two egress pulleys 11 or 62 to the area where as the cable 9 or 68 is pulled by the user, it creates a wide vector of training for the user. The user can now pull the cable 9 or 68 from the equipment freely in any direction without it rubbing or getting caught up.

Other units of equipment that attempt to orient a cable's egress point in various places around a user use one or two extension arms and one or two dual pulleys setups that mount on a swiveling housing attached to the end of the arms. Such devices are unsteady and cannot readily support heavier resistance training regimens. They are also difficult for the user to readily understand where to position the egress point for optimal training and are not readily suited for ease of recording the position in three-dimensional space the user trained in. Adding a swiveling pulley 30 or dual pulleys in front of two egress pulleys 11 or 62 to the area where as the cable is pulled by the user that creates an even more unique feature for the system. This third pulley 30 or dual pulleys mounted in front of the two fixed pulleys 11 or 62 allows for compass recorders to be easily affixed at the point of all three ranges of egress thereby allowing the user a simple and effective means to record training data and progress. It also makes it easy to return to the unit and repeat the exact training movement and measure the movement in three-dimensional space.

The unique product styling of all the units of equipment in these lines also sets them apart from other devices currently available. Their new look creates a feel of the user having his/her own space in which to train. They are also intuitive as to how any products in the line are to be used, unlike many other lines today that require instruction. Some of their features and advantages are:

1) Provide a means to position one or more repositionable egress trolleys or two or more fixed egress means positioned along a variety of single or dual walls, or single or dual tracks, rails, tubes or cylinders or other support means of a variety of shapes other than just a straight line (yet could include a straight line) relative to a user pulling on a handle connected to a connecting means connected to one or more resistance means and having one or more cable take-up means.
2) Egress point or points having one or two pulleys, which provide a way for the connector, means (cable or strap or other) to move in any direction once pulled away from the point where the pulley is affixed. This can be accomplished by having one of the pulleys in a three pulley assembly on a swiveling arm; or by widening the flange on the outer edge of the egress pulley/pulleys; or by having it fixed with rollers positioned along side the pulley or pulleys running in a parallel plain with the pulley or pulleys at the point at or near the point of egress of the cable, strap or other as it leaves the pulley. These rollers can be of any smooth, hard material such as plastic or metal and can be straight, convex or concave cylinders.
3) In the case where a single sidewall or track, rail, shaped tube or cylinder or other support means is used, cables or other connector means such as straps, chains or other may become exposed which can be dangerous to the user. A cover plate may be necessary in this case to cover the exposed connector means. Another way to hide exposed cable is to rout it through the inside of hollow tubing or cylinders with directional pulleys.
4) The take-up means for the connector means can be a variety of means including but not limited to counter weights, springs, retracting devices, brake systems. Such take up means can be positioned anywhere along the path of the connector means or at either end.
5) A standard configuration or set of configurations, which form the basis of a series or line of products, that takes that standard configuration and breaks it into different units of equipment exercising different body parts yet employing all the benefits of the movable trolley system and/or the multiple-fixed point egress system using a variety of shapes other than a straight line (yet could include a straight line). Each equipment in the line being capable of accepting a variety of attachments, benches, chairs, etc. that creates greater specificity and more versatility for the user.

6) Each equipment in the line being able to accept differing resistance means configurations and customized iterations of varying resistance thereby adapting the line for specific user groups in an easy, economical way.

7) Each equipment having a built in rack for holding different attachments, handles, bars and grips.

8) The units of equipment being configured in such a way as to allow the smallest possible footprint yet providing a workout area capable of servicing the training or rehabilitation needs of a wide variety of users in an ergonomically efficient way. They are also wheelchair accessible.

9) The units of equipment being designed in such a way as to allow the creation of space efficient room layouts offering new and dynamic looks to a facility yet conserving floor space.

10) A line of units of equipment that can be developed from one single standard set of parts that can be transformed into other series simply by repainting, redecaling, changing the resistance means and the attachments. A design that allows for the creation of Total Body units of equipment which use a standard set of parts which can be used to create a whole line of exercise units of equipment utilizing various combinations and mixes of egress points along one or two of the various shaped paths as they are positioned relative to the user in unilateral and bilateral formations which themselves can be fixed or move relative to themselves to create varying points of egress for the user to grab onto attachments connected to the connector means creating a line which enables the user to train specific body parts in three dimensional planes in ways that more closely resemble human movement patterns in real life situations.

11) The Total Body units optimize both form and function and provide the ability to create diverse products utilizing the core concept and virtually identical parts whereby manufacture of an entire new line of products is made possible by simple combinations of egress points.

12) A line of units of equipment that is intuitive to use.

13) A line of units of equipment that creates a feeling for the user of having his/her own space in which to workout in.

14) A line of units of equipment that creates a new look and product styling.

15) A line of advanced pulley system units of equipment which offer the user freedom of movement and the benefits similar to that of lifting free weights such as using the stabilizer muscles as well as the prime movers during an exercise yet is more advantageous in that the user is not restrained by resisting the force imposed by gravity only in the vertical vector, but allows the user the freedom to pull against force vectors in virtually any plane and at virtually any angle without having to drastically reposition one's body relative to the egress point. Such units of equipment are considered biomechanically optimized. Bilateral units provide bilateral workouts which stabilize the body and fix the points at which the user generates the force to move the weight, thereby providing a more focused, accurate and measurable movement. Cable units of equipment also allow for the optimum provision of resistance throughout the full range on normally varying carrying angles the body moves through when performing a natural motion and can match up perfectly with the varying strength curves created as a resistance is pulled though varying planes relative to the point of origin. Those that provide egress points fixed along an arced path more closely relate to the rotational patterns found in human movement.

16) A line of units of equipment using a third pulley mounted in front of the two fixed pulleys which allows for compass recorders to be easily affixed at the point of all three ranges of egress thereby allowing the user a simple and effective means to record training data and progress.

17) A line of units of equipment, which makes it easy to return to the unit and repeat the exact training movement used previously and measure the movement in three-dimensional space.

18) A line of units of equipment that are considered resistance training systems rather than just units of equipment due to fact that more can be done for more user groups in measurable, systematic ways using less units of equipment.

The foregoing specification and drawings have thus described and illustrated a novel improved exercise system that fulfills all of the objects and advantages sought therefore. Many changes, modifications, variations and other uses and applications of the subject invention will, however, become apparent to those skilled in the art after considering this specification which discloses the preferred embodiments thereof. All such changes, modifications, variations and other uses and applications which do not depart from the spirit and scope of the invention are deemed to be covered by the invention, which is to be limited only by the claims which follow.

What is claimed is:

1. Exercise equipment including a housing having a structural surface defining a prescribed concave arcuate contour, at least three cable exit points positioned along the structural surface, each exit point having passed therethrough a cable having a proximal end and a distal end, the proximal end of each cable being located outside the structural surface and being attached to a device that enables a user to exert a tensile force to the cable by pulling the cable in any desired direction, the distal end of each cable being coupled to a common source of resistance within the housing such that when the proximal end of each cable is pulled by a user, the resistance exerts a counterforce to such cable and the distal end of each cable coupled to a counter-resistance.

2. Exercise equipment as claimed in claim 1, wherein the source of resistance is variable.

3. Exercise equipment as claimed in claim 1, wherein said counter-resistance restore the cables to their original positions after being pulled by a user.

4. An exercise equipment as claimed in claim 3, wherein a the distal end of each cable is attached to a respective counter-resistance positioned next to the source of resistance, but before being attached to the counter-resistances the cables pass through or by a substantially horizontal plate which is positioned above the counter-resistances and attached to a substantially vertically positioned guiding means traveling along a substantially vertical path next to the source of resistance, a single cable being attached to the underside of the substantially horizontal plate and directed downward to and over a third pulley below, redirected by fourth pulleys to the source of resistance, so that when the user selects a particular resistance to lift at a particular egress point, the user pulls the proximal end of a particular cable external to the exercise equipment, the counter-resistance at the distal end of this cable lifts the substantially horizontal plate which, in turn, pulls on the single cable below which lifts the source of resistance, while other cables in the equipment which are not engaged by the user at that time are held in place by their respective counter-resistances.

5. Exercise equipment as claimed in claim 3, wherein the counter-resistances include means for distributing the source of resistance between any or all of the cables to which a tensile force is applied by a user.

6. Exercise equipment as claimed in claim 1, wherein the source of resistance includes a set of weights which are lifted when said proximal end of each cable is pulled by a user.

7. Exercise equipment as claimed in claim 6, wherein said counter-resistance comprise at least one counterweight which retains the cables in a retracted position when they are not being pulled by a user.

8. Exercise equipment as claimed in claim 7, wherein each cable, from its proximal end to its distal end, passes through the exit point and then passes through a series of pulleys, the distal end of each cable being attached to a counterweight housed within a vertical set of guide tracks; a horizontal plate with openings therein for passage of the cables therethrough, the plate being positioned above the counterweights and extending over and attached to a vertically positioned guide means traveling along a vertical shaft positioned between the set of weights and the counterweights, the plate being extended to reach out over the set of weights and being fastened to a set of guide tubes which guide the set of weights vertically along two upright guide rods extending downward through the set of weights; and a rod extending downward through a center of the set of weights with holes cut in it to allow a selector pin to slide into the set of weights so the user can select the desired weight to lift so that when the user pulls on the cable proximal end at a point of egress, the counterweight is lifted thereby lifting the horizontal plate assembly and a selected weight, other cables in the system not engaged by a user at that time being held in the ready position by their respective counterweights.

9. Exercise equipment as claimed in claim 8, wherein there is a second exercise equipment as recited in claim 8 positioned adjacent a first exercise equipment as recited in claim 8, said first and second exercise equipment being capable of being used simultaneously by a single user exercising two limbs or other parts of his body simultaneously or by two users simultaneously.

10. Exercise equipment as claimed in claim 9, wherein the first and second exercise equipment are placed side-by-side at a selected relative angle.

11. Exercise equipment as claimed in claim 9, wherein the first and second exercise equipment are integrated into a unitary construction.

12. Exercise equipment as claimed in claim 9, further comprising a chair or bench positioned adjacent the exercise equipment to enable a user to exert a tensile force to a cable while sitting or lying down.

13. Exercise equipment as claimed in claim 6, wherein the set of weights are lifted when said proximal ends of a plurality of said cables are pulled by a user.

14. Exercise equipment as claimed in claim 1, wherein the device that enables the user to exert a tensile force to a cable is selected from the group consisting of a handle, strap, belt, rope, bar and leg curl.

15. Exercise equipment as claimed in claim 14, further comprising racks for holding handles, grips, bars and other attachments.

16. Exercise equipment as calaimed in claim 1, wherein there is a second exercise equipment as recited in claim 1 positioned adjacent a first exercise equipment as recited in claim 1, said first and second exercise equipment being capable of being used simultaneously by a single user exercising two limbs or other parts of his body simultaneously or by two users simultaneously.

17. Exercise equipment as claimed in claim 16, wherein the first and second exercise equipment are placed side-by-side at a selected relative angle.

18. Exercise equipment as claimed in claim 16, wherein the first and second exercise equipment are integrated into a unitary construction.

19. Exercise equipment as claimed in claim 1, further comprising a chair or bench positioned adjacent the exercise equipment to enable a user to exert a tensile force to a cable while sitting or lying down.

20. Exercise equipment as claimed in claim 1, further comprising at least one rub block at the exit point of said cables.

21. Exercise equipment as claimed in claim 1, wherein the cable length between the proximal end of each cable and its associated exit point through which it passes is substantially equal, when no tensile force is applied thereto by a user.

22. Exercise equipment as claimed in claim 1, wherein a pair of pulleys are disposed at at least one cable exit point.

23. Exercise equipment as claimed in claim 22, further comprising a pair of rollers at said at least one exit point of said cables, said rollers having roller axes which are substantially parallel and substantially perpendicular to axes of said pulleys.

24. Exercise equipment as claimed in claim 22, further comprising a second pair of pulleys at said at least one exit point of said cables, said second pair of pulleys having pulley axes which are substantially parallel and substantially perpendicular to axes of said first pair of pulleys.

25. Exercise equipment including a frame having a track extending along a prescribed arcuate path; a movable trolley having an exit point for a cable, said trolley being repositionable to fixed positions along the track; a said cable extending through said exit point and having a proximal end, located outside the track and attached to a device that enables a user to exert a tensile force to the cable, and a distal end coupled to a source of resistance within the frame; means for maintaining a length of the cable between its proximal end and the exit point through which it passes substantially constant, independently of the position of the trolley along the track, when no tensile force is applied thereto by a user; a counterweight, separate from said source of resistance, coupled to the cable for retaining the cable in a retracted position when it is not being pulled by a user; and a one-step combination trolley locking and cable take-up mechanism for controlling the position and retraction of the cable to maintain the proximal end of the cable close to the trolley when the trolley is repositioned and no tensile force is applied by the user.

26. Exercise equipment as claimed in claim 25, wherein the source of resistance is variable.

27. Exercise equipment as claimed in claim 26, further comprising a counter-resistance which retains the cable in a retracted position when it is not being pulled by a user.

28. Exercise equipment as claimed in claim 26, wherein the source of resistance includes a set of weights which are lifted when the cable is pulled by a user.

29. Exercise equipment as claimed in claim 25, wherein there is a second exercise equipment as recited in claim 25, positioned adjacent a first exercise equipment as recited in claim 25, said first and second exercise equipment being capable of being used simultaneously by a single user exercising two limbs or other parts of his body simultaneously or by two users simultaneously.

30. Exercise equipment as claimed in claim 29, wherein the first and second exercise equipment are placed side-by-side at a selected relative angle.

31. Exercise equipment as claimed in claim 29, wherein the two units of first and second exercise equipment are integrated into a unitary construction.

32. Exercise equipment as claimed in claim 25, further comprising a chair or bench positioned adjacent the exercise equipment to enable a user to exert a tensile force to the cable while sitting or lying down.

33. Exercise equipment as claimed in claim 25, further comprising at least one rub block at the exit point of said cable.

34. Exercise equipment as claimed in claim 25, wherein a pair of pulleys is disposed at said cable exit point.

35. Exercise equipment as claimed in claim 34, further comprising a pair of rollers at the exit point of said cable, said rollers having roller axes which are substantially parallel and substantially perpendicular to axes of said pulleys.

36. Exercise equipment as claimed in claim 34, further comprising a second pair of pulleys at said at least one exit point of said cables, said second pair of pulleys having pulley axes which are substantially parallel and substantially perpendicular to axes of said first pair of pulleys.

37. Exercise equipment as claimed in claim 25, wherein the device that enables the user to exert a tensile force to the cable is selected from the group consisting of a handle, strap, belt, rope, bar and leg curl.

38. Exercise equipment as claimed in claim 37, further comprising racks for holding handles, grips, bars and other attachments.

39. Three-dimensional pulley cable exercise equipment having at least one swiveling element mounted on a frame to form an exit point of a cable; at least one cable, with a distal end and a proximal end, the distal end of the cable being attached to a source of resistance and the proximal end of the cable exiting the equipment past said swiveling element; and means to indicate a three-dimensional position of the exiting cable, whereby the three-dimensional position of the cable may be recorded.

40. Exercise equipment as recited in claim 39, wherein said swiveling element includes at least one pulley.

41. Exercise equipment as claimed in claim 40, wherein said at least one pulley includes at least three pulleys, two of which are arranged with their axes substantially in parallel.

42. Exercise equipment as claimed in claim 41, wherein said at least one pulley includes two pairs of pulleys, each pair having substantially parallel axes, with the axes of one pair being substantially perpendicular to the axes of the other pair.

43. Exercise equipment as claimed in claim 40, wherein said at least one pulley includes at least two pulleys which are arranged with their axes substantially in parallel.

44. Exercise equipment including a framed housing having a curved path, at least one cable exit point selectively positioned along the curved path, said exit point having passed therethrough a cable having a proximal end and a distal end, the proximal end being located outside the curved path and attached to means that enables a user to exert a tensile force to the cable against a selected resistance, with the distal end being coupled to a source of said selected resistance, such that when the proximal end of the cable is pulled by a user, the resistance exerts a counterforce at the distal end; and cable take-up means, disposed between the proximal end and the distal end, for maintaining the length of the cable between its proximal end and the exit point through which it passes substantially constant, independent of the position of the exit point along the curved path, when no tensile force is applied thereto by a user and operating simultaneously with any repositioning of the cable exit point along the curved path.

45. Exercise equipment as claimed in claim 44, further comprising at least one rub block at the exit point of said cable.

46. Exercise equipment as claimed in claim 44, wherein a pair of pulleys is disposed at said cable exit point.

47. Exercise equipment as claimed in claim 46, further comprising a second pair of pulleys at said at least one exit point of said cables, said second pair of pulleys having pulley axes which are substantially parallel and substantially perpendicular to axes of said first pair of pulleys.

48. Exercise equipment including a housing having a structural surface defining a prescribed contour, multiple cable exit points positioned along the structural surface, each exit point having passed therethrough a cable having a proximal end and a distal end, the proximal end of each cable being located outside the structural surface and being attached to a device that enables a user to exert a tensile force to the cable by pulling the cable in any desired direction, the distal end of each cable being coupled to a common source of resistance within the housing such that when the proximal end of each cable is pulled by a user, the resistance exerts a counterforce to such cable, and means for retaining each cable in a retracted position, when it is not being pulled by a user, even when one or more other cables are pulled by a user.

49. Exercise equipment as claimed in claim 48, wherein the source of resistance is variable.

50. Exercise equipment as claimed in claim 48, wherein the source of resistance includes a set of weights which are lifted when said proximal end of each cable is pulled by a user.

51. Exercise equipment as claimed in claim 50, wherein said retaining means comprises at least one counterweight which retains the cables in a retracted position when they are not being pulled by a user.

52. Exercise equipment as claimed in claim 51, wherein each cable, from its proximal end to its distal end, passes through the exit point and then passes through a series of pulleys, the distal end of each cable being attached to a counterweight housed within a vertical set of guide tracks; a horizontal plate with openings therein for passage of the cables therethrough, the plate being positioned above the counterweights and extending over and attached to a vertically positioned guide means traveling along a vertical shaft positioned between the set of weights and the counterweights, the plate being extended to reach out over the set of weights and being fastened to a set of guide tubes which guide the set of weights vertically along two upright guide rods extending downward through the set of weights; and a rod extending downward through a center of the set of weights with holes cut in it to allow a selector pin to slide into the set of weights so the user can select the desired weight to lift so that when the user pulls on the cable proximal end at a point of egress, the counterweight is lifted thereby lifting the horizontal plate assembly and a selected weight, other cables in the system not engaged by a user at that time being held in the ready position by their respective counterweights.

53. Exercise equipment as claimed in claim 52, wherein there is a second exercise equipment as recited in claim 50 positioned adjacent a first exercise equipment as recited in claim 50, said first and second exercise equipment being capable of being used simultaneously by a single user exercising two limbs or other parts of his body simultaneously or by two users simultaneously.

54. Exercise equipment as claimed in claim 53, wherein the first and second exercise equipment are placed side-by-side at a selected relative angle.

55. Exercise equipment as claimed in claim 53, wherein the first and second exercise equipment are integrated into a unitary construction.

56. Exercise equipment as claimed in claim 53, further comprising a chair or bench positioned adjacent the exercise equipment to enable a user to exert a tensile force to a cable while sitting or lying down.

57. Exercise equipment as claimed in claim 50, wherein the source of resistance includes a set of weights are lifted when said proximal ends of a plurality of said cables are pulled by a user.

58. Exercise equipment as claimed in claim 48, wherein the device that enables the user to exert a tensile force to a cable is selected from the group consisting of a handle, strap, belt, rope, bar and leg curl.

59. Exercise equipment as claimed in claim 58, further comprising racks for holding handles, grips, bars and other attachments.

60. Exercise equipment as claimed in claim 48, wherein there is a second exercise equipment as recited in claim 13 positioned adjacent a first exercise equipment as recited in claim 13, said first and second exercise equipment being capable of being used simultaneously by a single user exercising two limbs or other parts of his body simultaneously or by two users simultaneously.

61. Exercise equipment as claimed in claim 60, wherein the first and second exercise equipment are placed side-by-side at a selected relative angle.

62. Exercise equipment as claimed in claim 60, wherein the first and second exercise equipment are integrated into a unitary construction.

63. Exercise equipment as claimed in claim 48, further comprising a chair or bench positioned adjacent the exercise equipment to enable a user to exert a tensile force to a cable while sitting or lying down.

64. An exercise equipment as claimed in claim 50, wherein the distal end of each cable is attached to a counter-resistance positioned next to the source of resistance, but before being attached to the counter-resistances the cables pass through or by a substantially horizontal plate which is positioned above the counter-resistances and attached to a substantially vertically positioned guiding means traveling along a substantially vertical path next to the source of resistance, a single cable being attached to the underside of the substantially horizontal plate and directed downward to and over a third pulley below, redirected by fourth pulleys to the source of resistance, so that when the user selects a particular resistance to lift at a particular egress point, the user pulls the proximal end of a particular cable external to the exercise equipment, the counter-resistance at the distal end of this cable lifts the substantially horizontal plate which, in turn, pulls on the single cable below which lifts the source of resistance, while other cables in the equipment which are not engaged by the user at that time are held in place by their respective counter-resistances.

65. Exercise equipment as claimed in claim 48, wherein a pair of pulleys are disposed at at least one cable exit point.

66. Exercise equipment as claimed in claim 65, further comprising a pair of rollers at said at least one exit point of said cables, said rollers having roller axes which are substantially parallel and substantially perpendicular to axes of said pulleys.

67. Exercise equipment as claimed in claim 65, further comprising a second pair of pulleys at said at least one exit point of said cables, said second pair of pulleys having pulley axes which are substantially parallel and substantially perpendicular to axes of said first pair of pulleys.

68. Exercise equipment as claimed in claim 48, further comprising at least one rub block at the exit point of said cables.

69. Exercise equipment as claimed in claim 48, wherein the cable length between the proximal end of each cable and its associated exit point through which it passes is substantially equal, when no tensile force is applied thereto by a user.

70. Exercise equipment as claimed in claim 48, wherein said prescribe contour is arcuate.

71. Exercise equipment as claimed in claim 48, wherein said retaining means includes means for distributing the source of resistance between any or all of the cables to which a tensile force is applied by a user.

* * * * *